US007021437B2

(12) United States Patent
Ghiassi

(10) Patent No.: US 7,021,437 B2
(45) Date of Patent: Apr. 4, 2006

(54) EXPANDABLE LUGGAGE SYSTEM

(76) Inventor: Mohssen Ghiassi, 62 Rancheria Rd., Kentfield, CA (US) 94904

( * ) Notice: Subject to any disclaimer, the term of this patent is extended or adjusted under 35 U.S.C. 154(b) by 296 days.

(21) Appl. No.: 10/608,936

(22) Filed: Jun. 27, 2003

(65) Prior Publication Data

US 2004/0262111 A1 Dec. 30, 2004

(51) Int. Cl.
*A45C 7/00* (2006.01)
*A45C 13/36* (2006.01)

(52) U.S. Cl. ..... 190/103; 190/22; 190/126; 190/127; 383/2

(58) Field of Classification Search ..... 190/103–105, 190/126, 14, 21, 22, 127; 383/2
See application file for complete search history.

(56) References Cited

U.S. PATENT DOCUMENTS 1,341,099 A * 5/1920 Abramson ..... 190/103
3,321,053 A * 5/1967 Doppelt ..... 190/104
3,443,671 A * 5/1969 Dyke ..... 190/103
3,480,118 A * 11/1969 Dyke ..... 190/103
3,523,596 A * 8/1970 Dyke ..... 190/103
4,128,150 A * 12/1978 Popkin et al. ..... 190/103
4,312,431 A * 1/1982 Corey ..... 190/104
4,366,886 A * 1/1983 Tawil ..... 190/103
4,773,515 A * 9/1988 Kotkins, Jr. ..... 190/103
5,080,206 A * 1/1992 Tawil ..... 190/103
5,252,161 A * 10/1993 Chang et al. ..... 156/196
6,053,382 A * 4/2000 Wyant ..... 224/153
6,220,411 B1 * 4/2001 Scicluna et al. ..... 190/103

* cited by examiner

*Primary Examiner*—Sue A. Weaver
(74) *Attorney, Agent, or Firm*—Risto A. Rinne, Jr.

(57) ABSTRACT

An apparatus for the containment of objects includes a container having at least one expandable portion that includes an expandable surface and a plurality of elastomers connected to the container and to the expandable portion that normally supplies a force to the expandable surface to retract it toward the container. When the objects exceed the normal volume in the container and the container is closed, the elastomers expand where needed and to a minimum extent as needed sufficient to accommodate the objects. When the objects do not exceed the normal volume and the container is closed, the elastomers automatically retract the expandable portion into a retracted position.

14 Claims, 11 Drawing Sheets

MULTIPLE EXPANSIONS OF THE SAME SIDE

EXPANDABLE LUGGAGE SYSTEM

BACKGROUND OF THE INVENTION

1. Field of the Invention

The present invention, in general relates to containers and, more particularly, to automatically expandable luggage.

Expandable luggage is well known. A foldable section of fabric surrounds a suitcase, for example. A zipper is closed to contract the fabric and is opened to allow the section of fabric to expand.

While this is helpful, there are a number of drawbacks. For example, if only a small increase in capacity is warranted, this cannot be attained. Opening up the zipper will open up all of the foldable fabric, thereby going from a compact-collapsed mode into a fully extended open mode.

If only a small increase in capacity is desired and a large increase is provided, then the items in storage experience looseness and are subject to movement inside of the expanded suitcase.

Ideally, a proportional increase in capacity is desired, one that can progressively accommodate the size of the item(s) that are being enclosed in an article of luggage.

The term "luggage" as used herein is intended to refer to any type of a container, suitcase, backpack, daypack, duffle-bag, briefcase, carry-on bag, or any similar type of a portable luggage item, etc. If the article is intended to contain items for transport and is intended to be moved or carried by an individual, the instant invention appertains.

For example, lap top briefcases, camera bags, containers intended to house optical or video instruments, electronic, or other specialty tools and equipment can also benefit from the instant invention and are included whenever the term "luggage" is used herein.

Another problem with prior art expandable luggage systems is that they do not provide variety in the shape of the expandable portion. Typically, the expandable section includes a section of fabric having the same width and therefore providing a uniform increase in the effective thickness of the suitcase.

Sometimes, a luggage item is intended to carry a variety of items where a particular predetermined shape is suitable. On occasion, an accessory item (a tripod, for example) may also be included in the container. When the accessory item is carried, not only is an expanse in volume required, but the expanse my require an uneven profile. As mentioned hereinabove, it is desirable to provide only enough expansion to securely contain the accessory item without introducing excessive slack, and yet it is desirable to be able to accommodate odd expansive shapes when necessary.

Another example might be with a backpack. In an outer storage pocket of the backpack, a user may store a pair of binoculars on one excursion and a camera with a telephoto lens on another excursion. To be able to expand a storage pocket sufficient to accommodate either accessory item without also introducing slack (for the smaller item) has heretofore been unattainable.

Furthermore, it is desirable to be able to include multiple levels of automatic expansion, on top of the other in a way that is less obtrusive and with an aesthetically pleasing appearance. This would provide the ultimate in expandability, convenience, and appearance.

It is also desirable to make the expansion occur automatically. It takes time for a user to unzip a perimeter of a suitcase sufficient to permit expansion to occur and to close the zipper when expansion is no longer needed. Another step is required.

It would be ideal if items could be inserted into the luggage and the luggage closed in a normal fashion whereby the luggage would expand automatically when needed, to a degree as needed, and in whatever odd shape was required.

With carry-on luggage items (i.e., those that are typically allowed in the passenger area of an aircraft), often there is one important item that simply must be also carried aboard. Without sufficient expansion, this is not possible.

Or, sometimes the carry-on is used as an "overnighter" bag whereby if it can be expanded to house a few additional clothing or personal hygiene items then the traveler is spared from having to "check" any luggage on board. This expedites his ability to check-in prior to flight and also leave the airport upon arriving at the conclusion of each flight segment.

With luggage items, appearance is also important. An enlarged perimeter, commonly referred to as "piping" is often used for strength and as an aid in improving aesthetics.

With conventional expandable luggage systems, the circumferential zipper that is used to contain the expandable section of fabric is not especially attractive. It would enhance aesthetic appearance if the expandable section did not include a zipper, but preferably, was indicated only by a section of piping, a row of binding tape, or even a simple seam with a row of stitching.

With conventional expandable luggage, the unused portion of the expansion dangles on the bag, creating imbalance as well as an aesthetically unpleasant appearance. A further problem with the unused dangling expansion of conventional expandable luggage is the shifting of contents that occurs in the unused space. This leads to wrinkles and creases on clothes, as well as a potential for damage or breakage occurring to the shifting contents.

Accordingly, there exists today a need for an expandable luggage system that helps to ameliorate the aforementioned problems.

Clearly, such an apparatus would be a useful and desirable device.

2. Description of Prior Art

Expandable suitcases are, in general, known. While the structural arrangements of the above known types of devices, at first appearance, may have similarities with the present invention, they differ profoundly and in material respects. These differences, which will be described in more detail hereinafter, are essential for the effective use of the invention and which admit of the advantages that are not available with the known prior devices.

OBJECTS AND SUMMARY OF THE INVENTION

It is an object of the present invention to provide an expandable luggage system that includes an attractive expandable section.

It is also an important object of the invention to provide an expandable luggage system that provides for automatic expansion, as needed.

Another object of the invention is to provide an expandable luggage system that provides for a proportional amount of expansion, as necessary, to accommodate the items that are contained in the luggage system.

Still another object of the invention is to provide an expandable luggage system that is adapted to expand proportionally so as to accommodate odd shaped items.

Still yet another object of the invention is to provide an expandable luggage system that is adapted to include multiple layers of expandability, as desired.

Yet another important object of the invention is to provide an expandable luggage system that is designed to accommodate very unusual shapes, such as an accessory item may include.

Still yet another important object of the invention is to provide an expandable luggage system that is adapted for use with any type of a portable container.

Still yet a first further important object of the invention is to provide an expandable luggage system that is adapted for use with a variety of luggage items.

Still yet a second further important object of the invention is to provide an expandable luggage system that is adapted for use with backpacks.

Still yet a third further important object of the invention is to provide an expandable luggage system that is adapted for use with suitcases.

Still yet a fourth further important object of the invention is to provide an expandable luggage system that is adapted for use with storage and transport containers for specialty equipment items.

Still yet a fifth further important object of the invention is to provide an expandable luggage system that is adapted for use with dufflebags.

Still yet a sixth further important object of the invention is to provide an expandable luggage system that is adapted for use with briefcases.

Still yet a seventh further important object of the invention is to provide an expandable luggage system that is adapted for use with carry-on bags.

Still yet a eighth further important object of the invention is to provide an expandable luggage system that is adapted for use with portable computer storage bags.

Still yet a ninth further important object of the invention is to provide an expandable luggage system that is adapted for use with containers that are formed primarily of a fabric material.

Still yet a tenth further important object of the invention is to provide an expandable luggage system that is adapted for use with containers that are formed primarily of a rigid material.

Still yet an eleventh further important object of the invention is to provide an expandable luggage system that is adapted for use with containers that are formed primarily of a plastic material.

Still yet a twelfth further important object of the invention is to provide an expandable luggage system that is adapted for use with containers that are formed primarily of a composite material.

Still yet a thirteenth further important object of the invention is to provide an expandable luggage system that automatically retracts an extendible portion when an increase in volume is no longer needed.

Still yet a fourteenth further important object of the invention is to provide an expandable luggage system that automatically retracts an extendible portion so that an extendible fabric portion is automatically retracted and disposed substantially within a container when an increase in volume is no longer needed.

Still yet a fifteenth further important object of the invention is to provide an expandable luggage system that includes an expandable pocket.

Still yet a seventeenth further important object of the invention is to provide an expandable luggage system that includes an expandable pocket that is attached to an expandable side of a container.

Still yet an eighteenth further important object of the invention is to provide an expandable luggage system that includes a method for ensuring that a expandable section of fabric folds inward when it is retracted.

Still yet an nineteenth further important object of the invention is to provide an expandable luggage system that permits expansion to be activated by either a pulling or a pushing force, namely by pulling outward on an exterior portion of the luggage system or by placement of an excess of contents for an initial contracted volume in the luggage system thereby pushing the exterior portion outward when the luggage is being closed.

Still yet a twentieth further important object of the invention is to provide an expandable luggage system that includes a variety of configurations for providing automatic expansion to occur between two points when an elastomer is attached at a first distal end to an anchor point and at an opposite proximal end to the either of the two points or to a member that one of the two points is attached to.

Briefly, an expandable luggage system that is constructed in accordance with the principles of the present invention has a container that includes a predetermined shape and size. At least one expandable section of fabric is attached to the container along one perimeter side of the fabric. An elastomeric member or plurality thereof are included and are attached on one end thereof to the container and on an opposite end to a distal point of the expandable section of fabric or alternatively, to an opposite plane that is attached to the expandable section of fabric. The elastomeric member(s) applies a force to urge the distal end of the fabric toward the container. When the container is empty or is not filled to capacity, the elastomeric member(s) urge the expandable section of fabric into a fully retracted position adjacent to the container. When the container is filled beyond capacity, the elastomeric member(s) expand, as needed, to proportionally accommodate the size and shape of the item(s) that are placed in the container and which extend in size beyond the normal capacity (i.e., in the retracted position) of the container. Modifications are described that include the use of piping, frame members, retraction guides, and multiple expandable layers.

Inset A provides detail of a first method of controlling the direction of a fold.

Inset B provides detail of an alternative method of controlling the direction of the fold.

Figure 3:
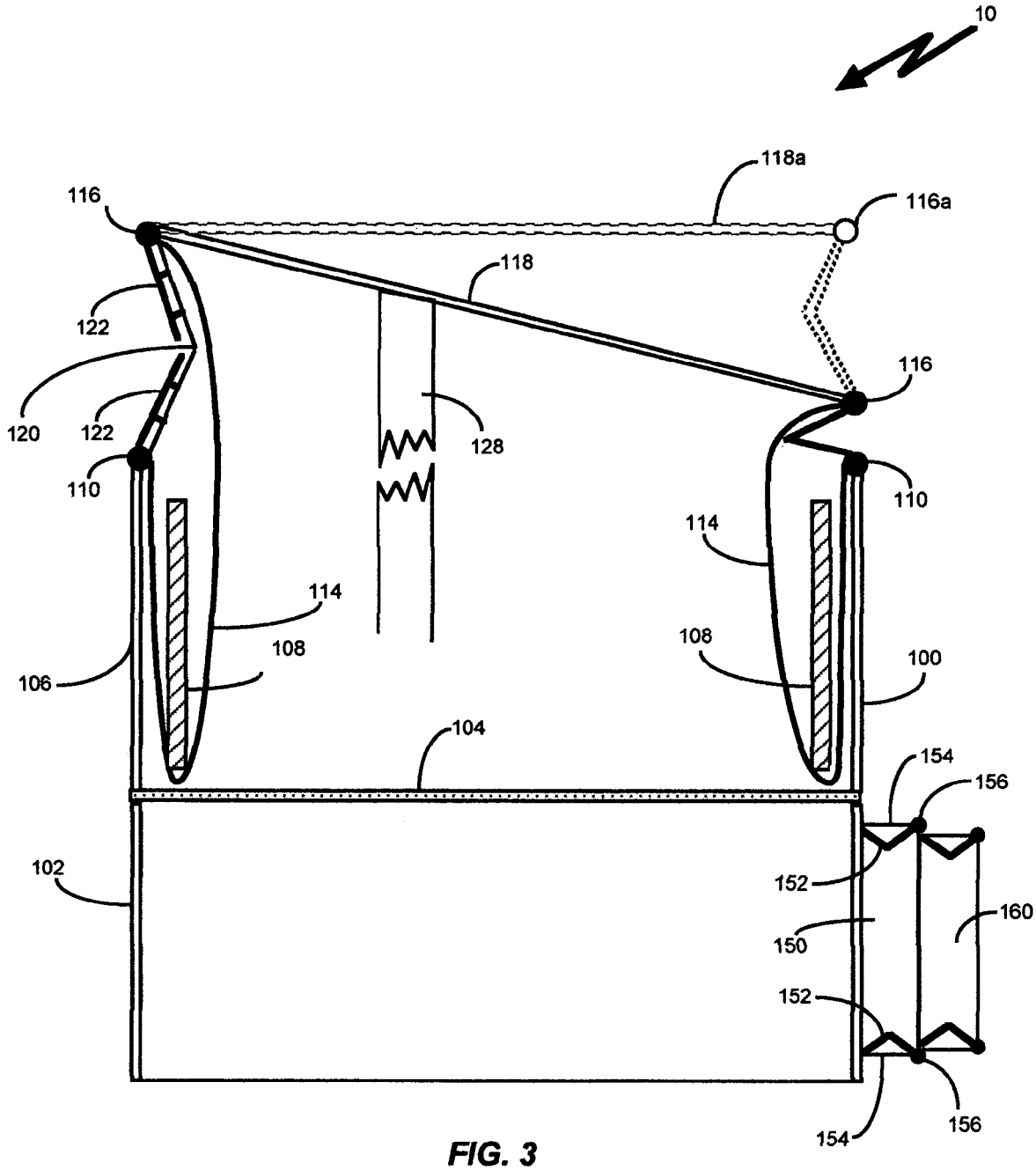

FIG. 3 is a cross-section of a modified container utilizing the expandable luggage system in both partially and fully open (extended) positions.

Figure 4:
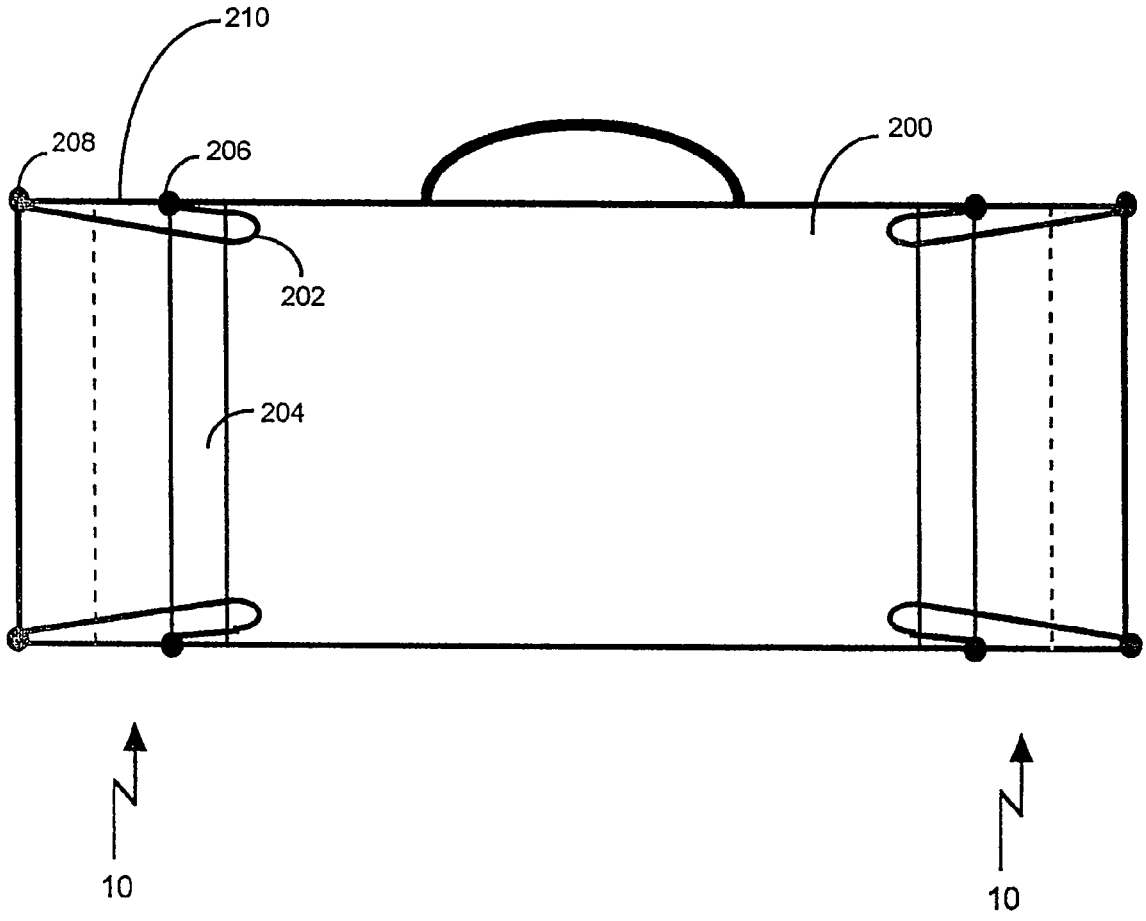

FIG. 4 is a side view of a duffle bag with two opposite expandable ends attached thereto of the expandable luggage system.

Figure 5:
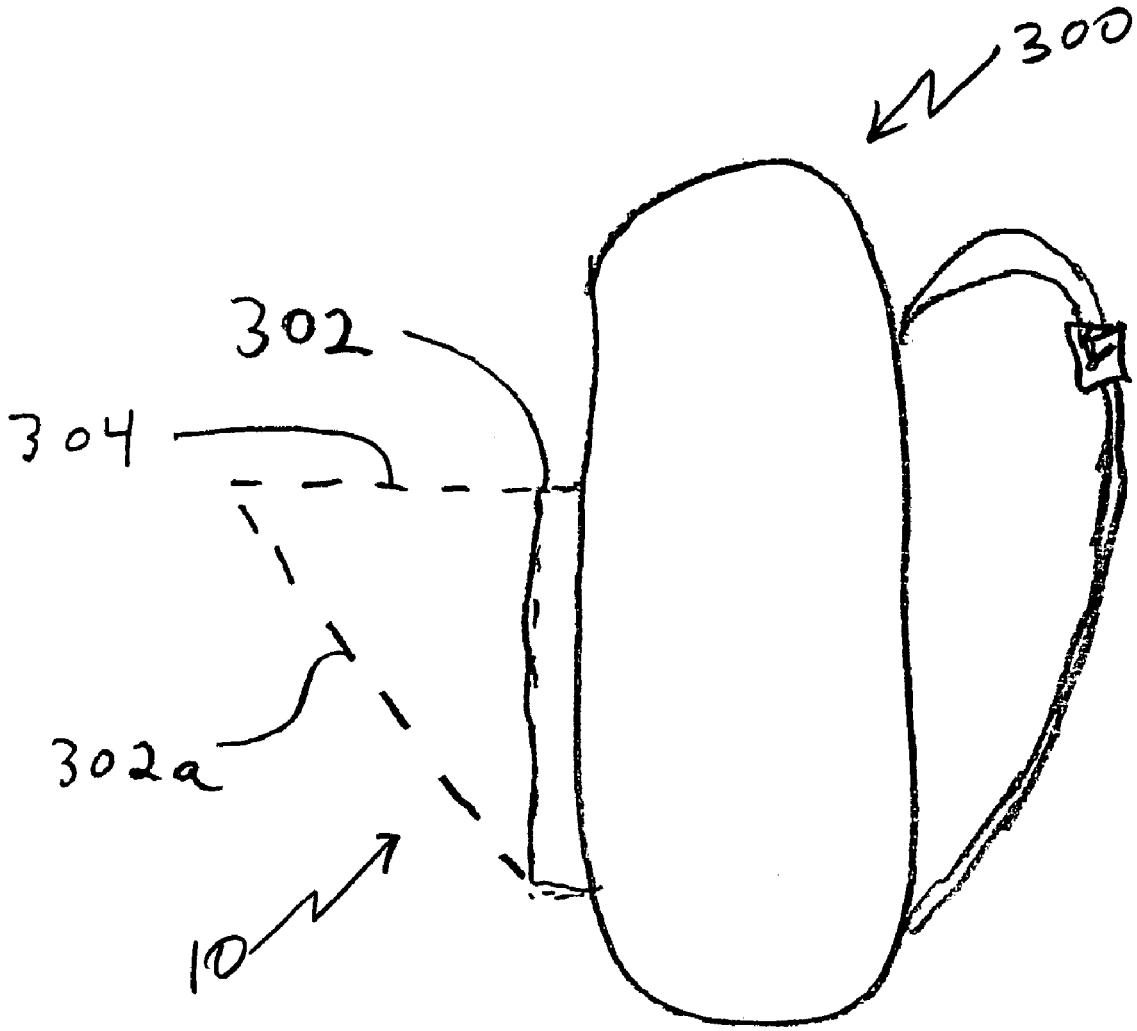

FIG. 5 is a side view of a backpack utilizing the expandable luggage system.

Figure 6:
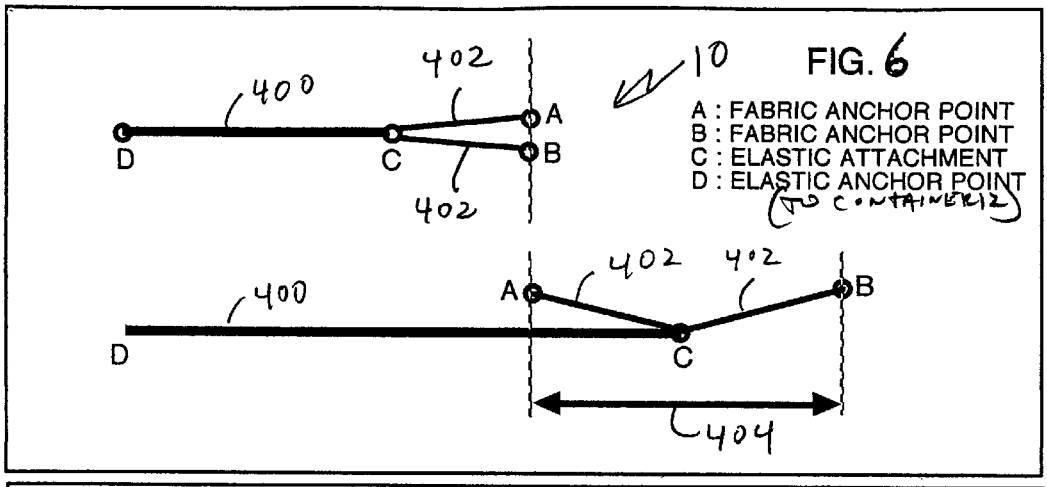
Figure 6A:
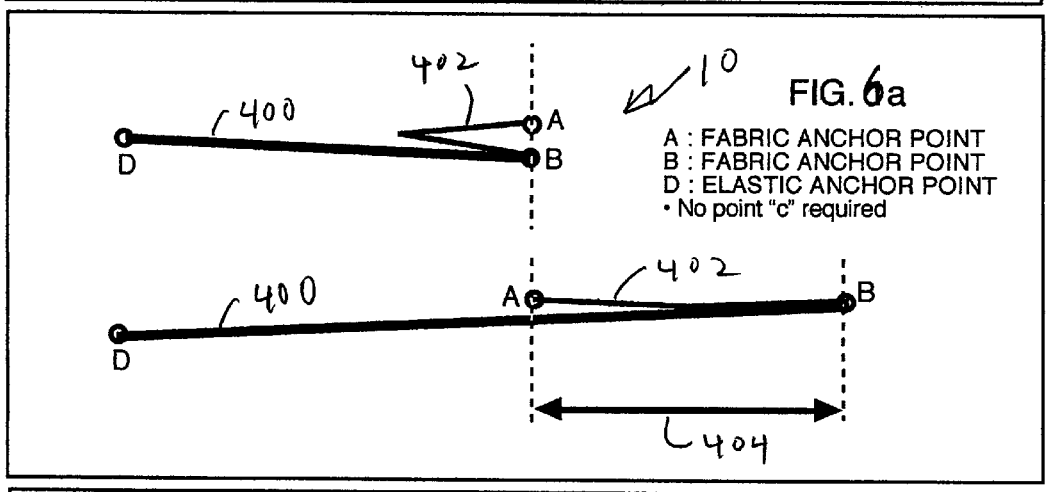
Figure 6B:
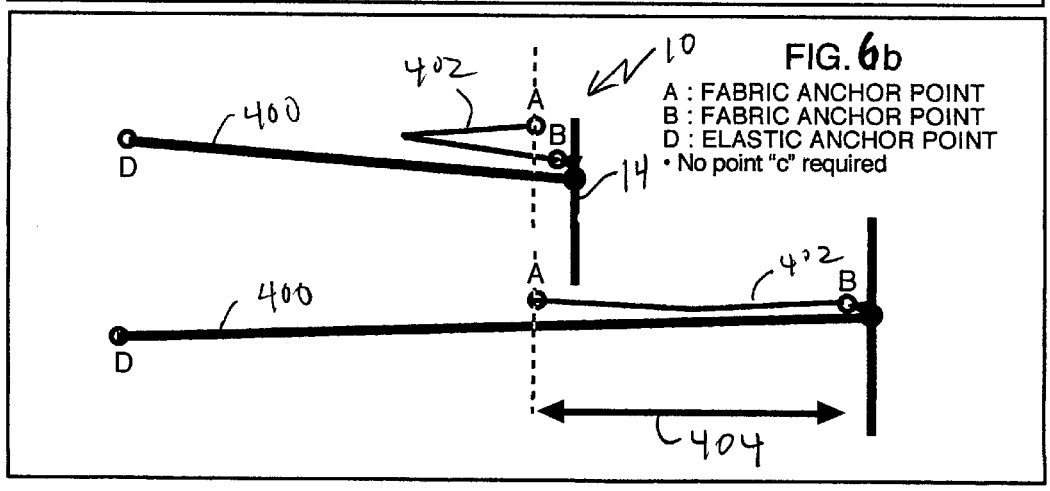

FIGS. 6, 6*a*, and 6*b* show a variety of modifications of the attachment points of the invention.

Figure 7:
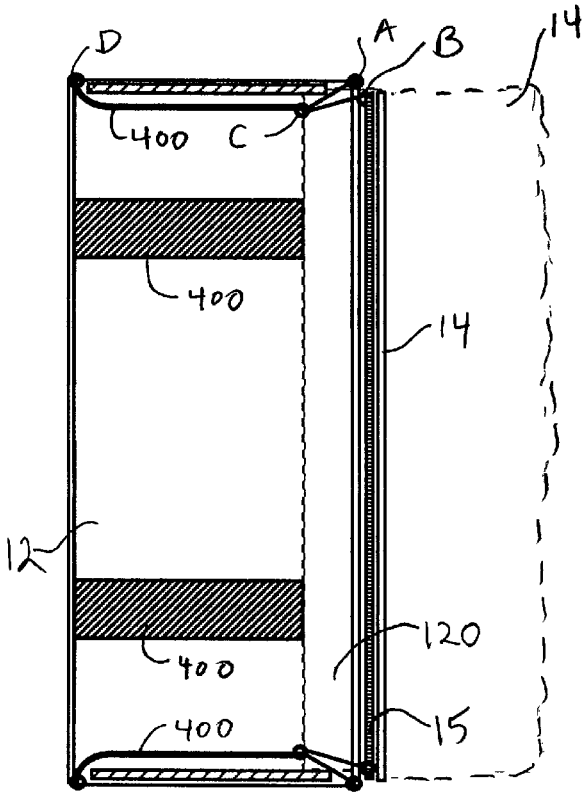
Figure 7A:
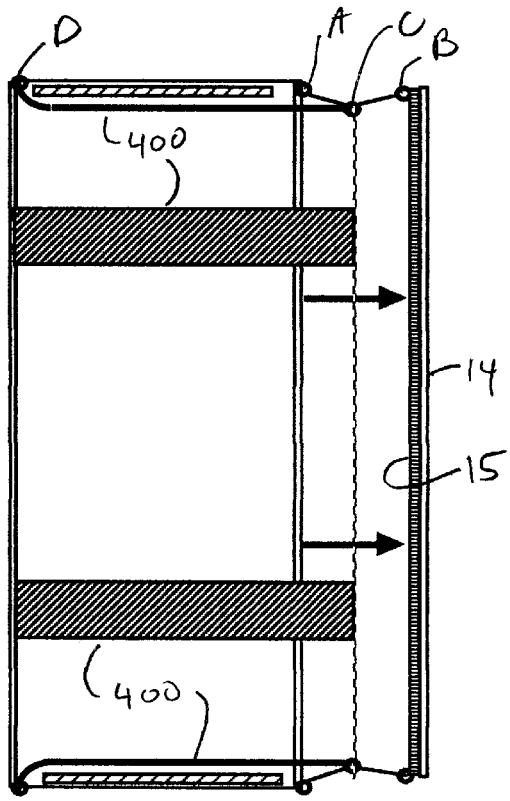

FIGS. 7 and 7*a* show a single expansion application utilizing the method of FIG. 6.

Figure 8:
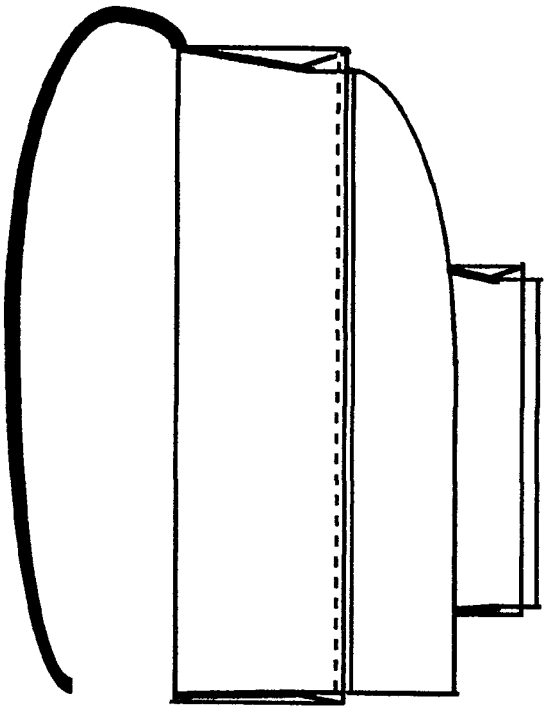
Figure 8A:
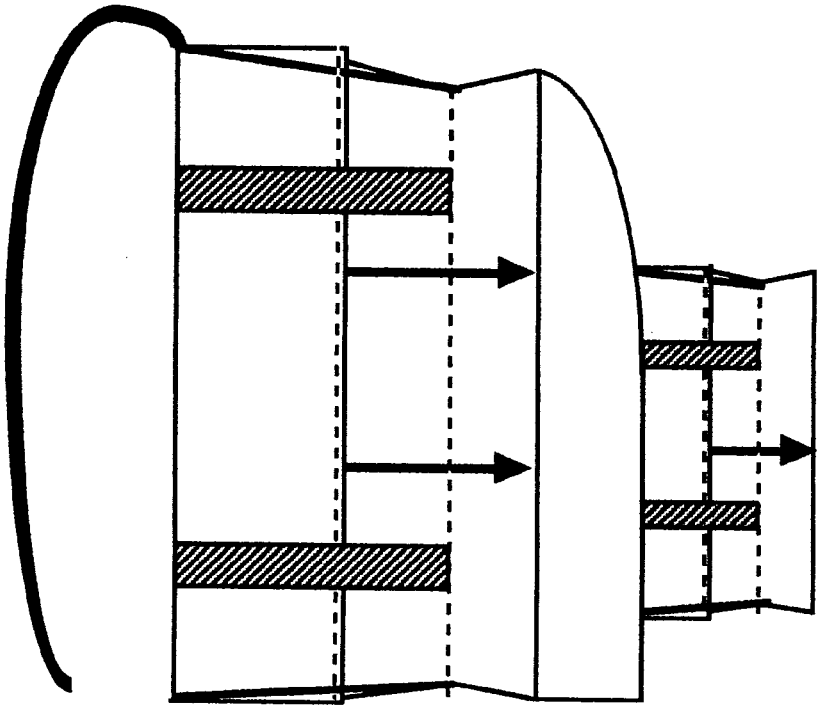

FIGS. 8 and 8*a* show a double expansion application in the same direction for a modified backpack utilizing the method of FIG. 6.

Figure 9:
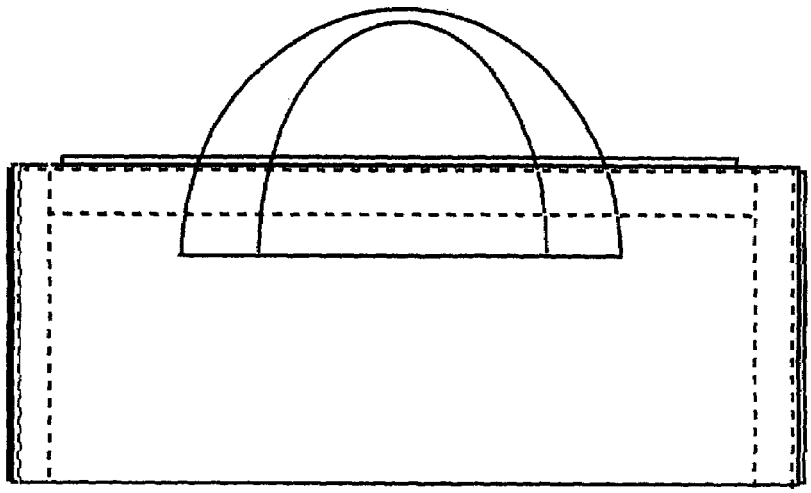
Figure 9A:
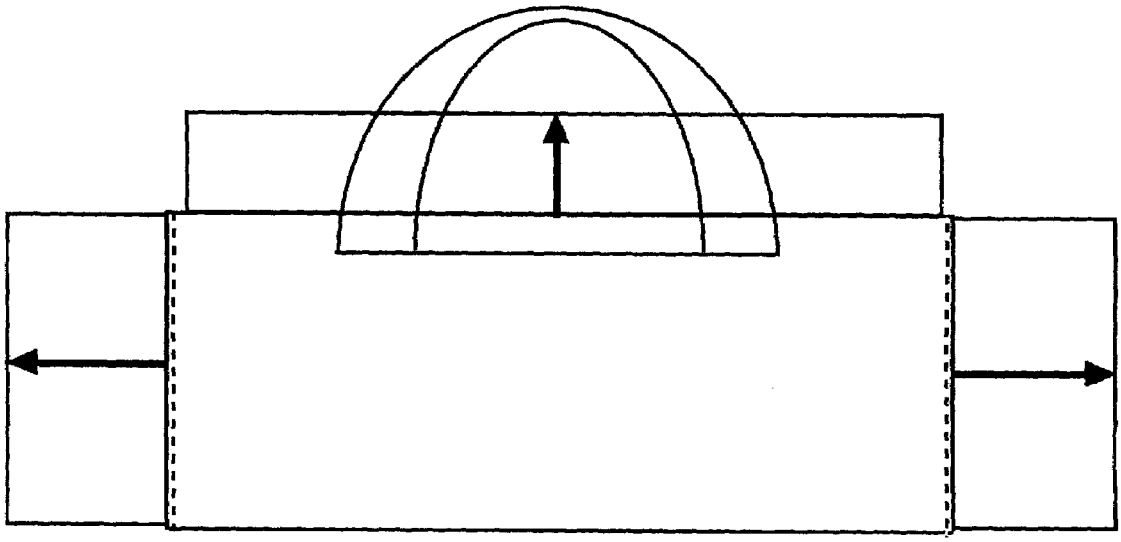

FIGS. 9 and 9*a* show a multiple expansion application with expansion in three directions utilizing any of the methods of FIGS. 6, 6*a*, or 6*b*.

Figure 10:
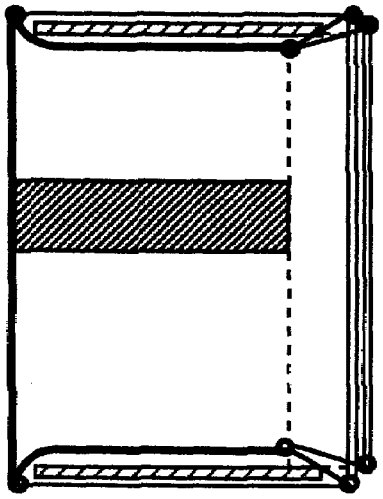
Figure 10A:
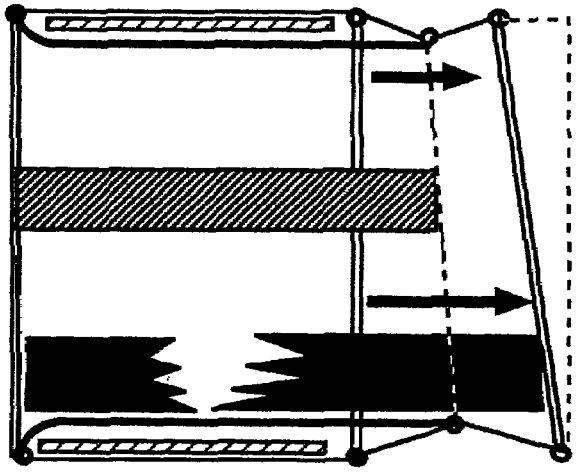

FIGS. 10 and 10*a* show an uneven expansion of a single panel utilizing the method of FIG. 6.

Figure 11:
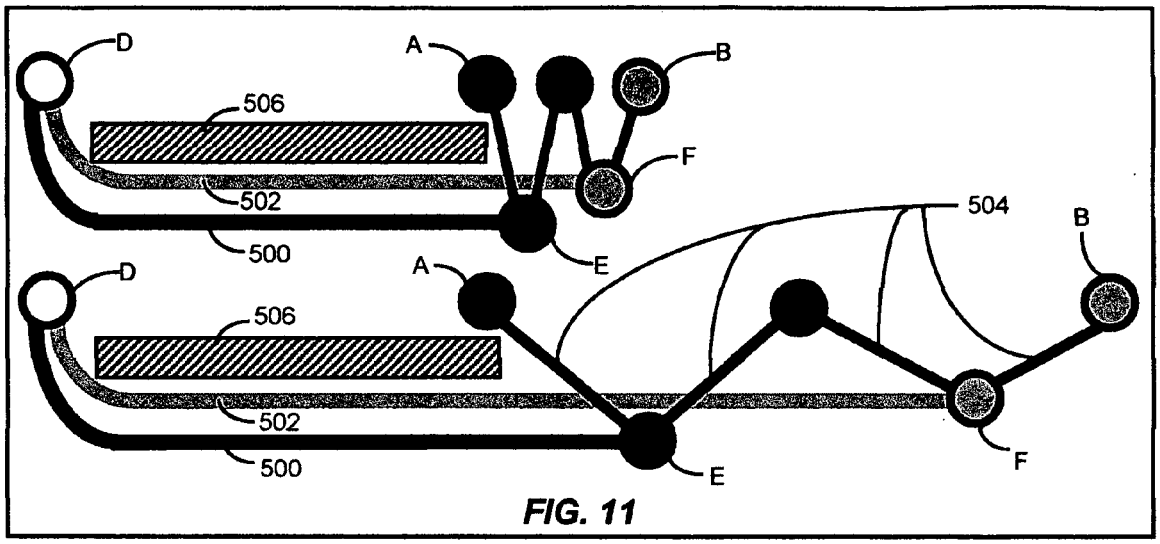
Figure 11A:
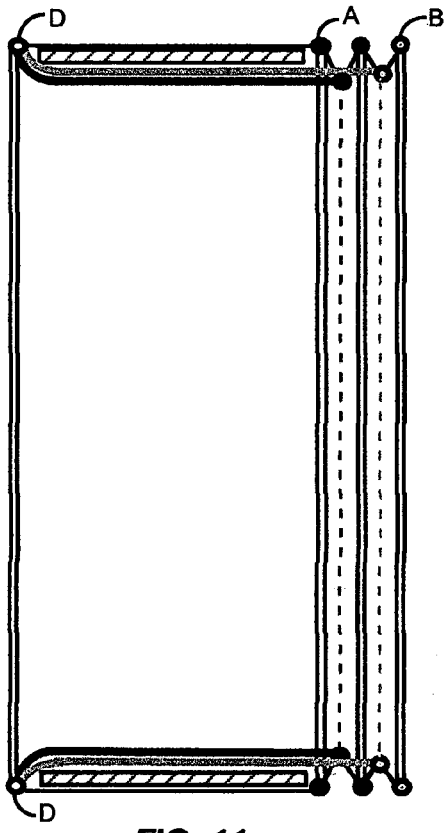
Figure 11B:
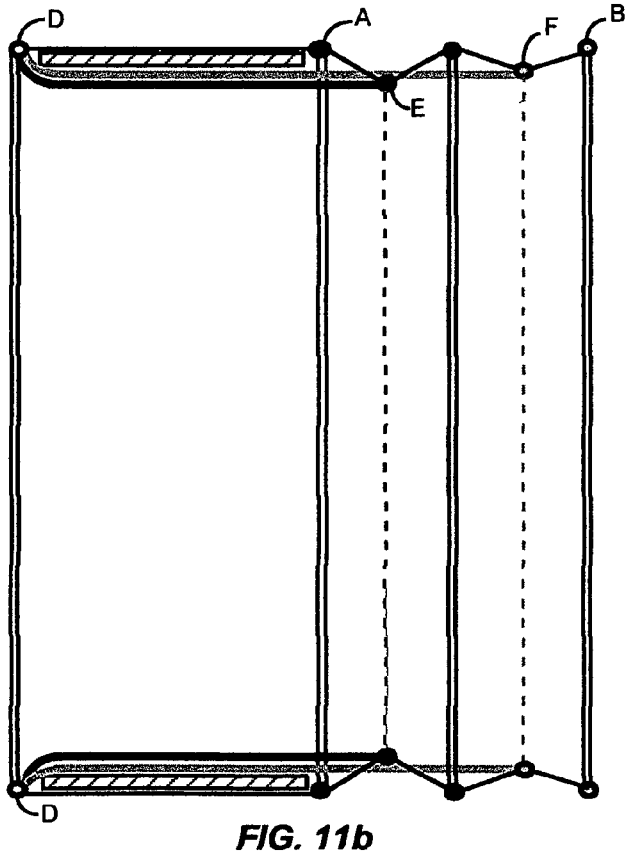
Figure 1:
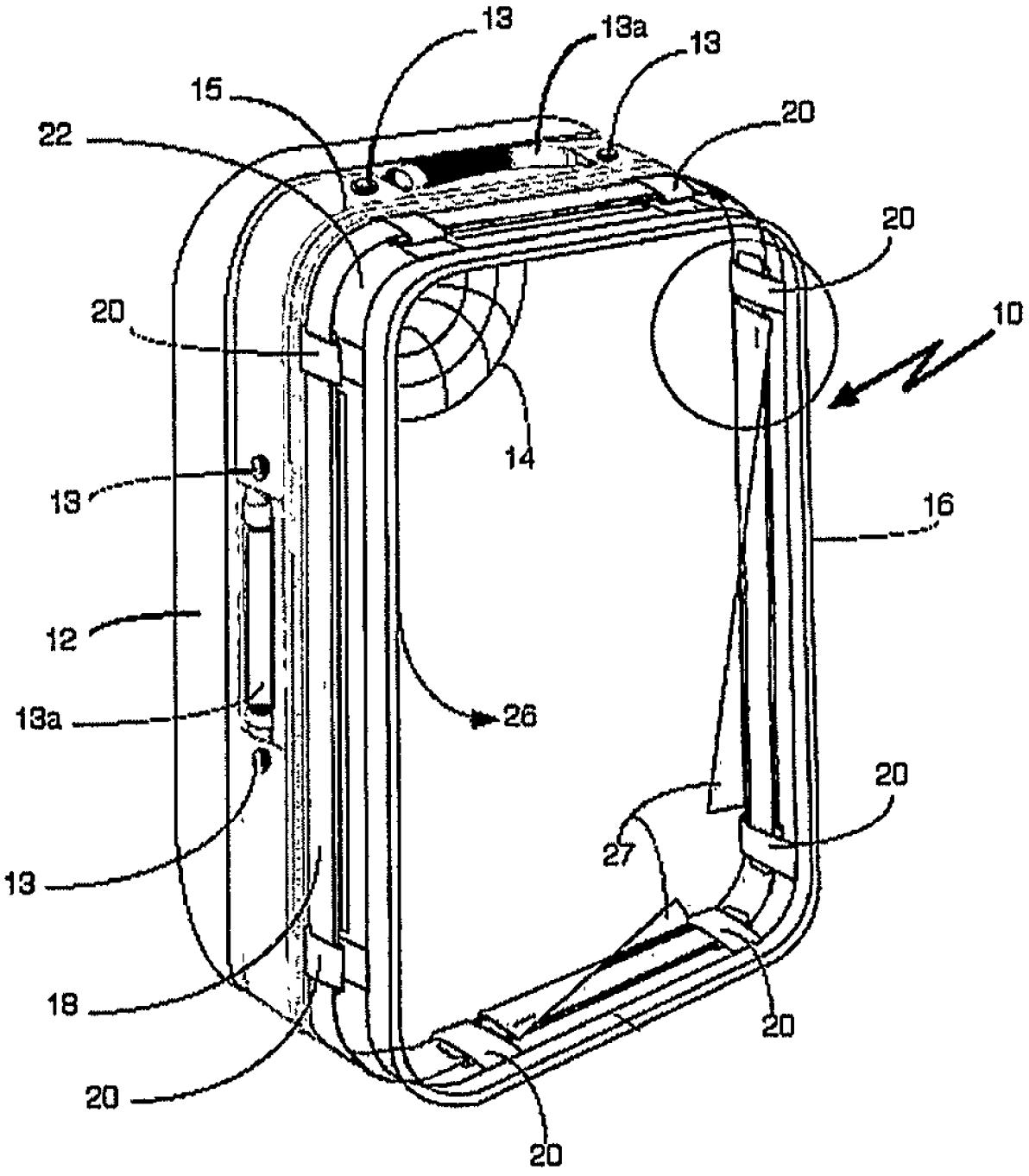
Figure 2:
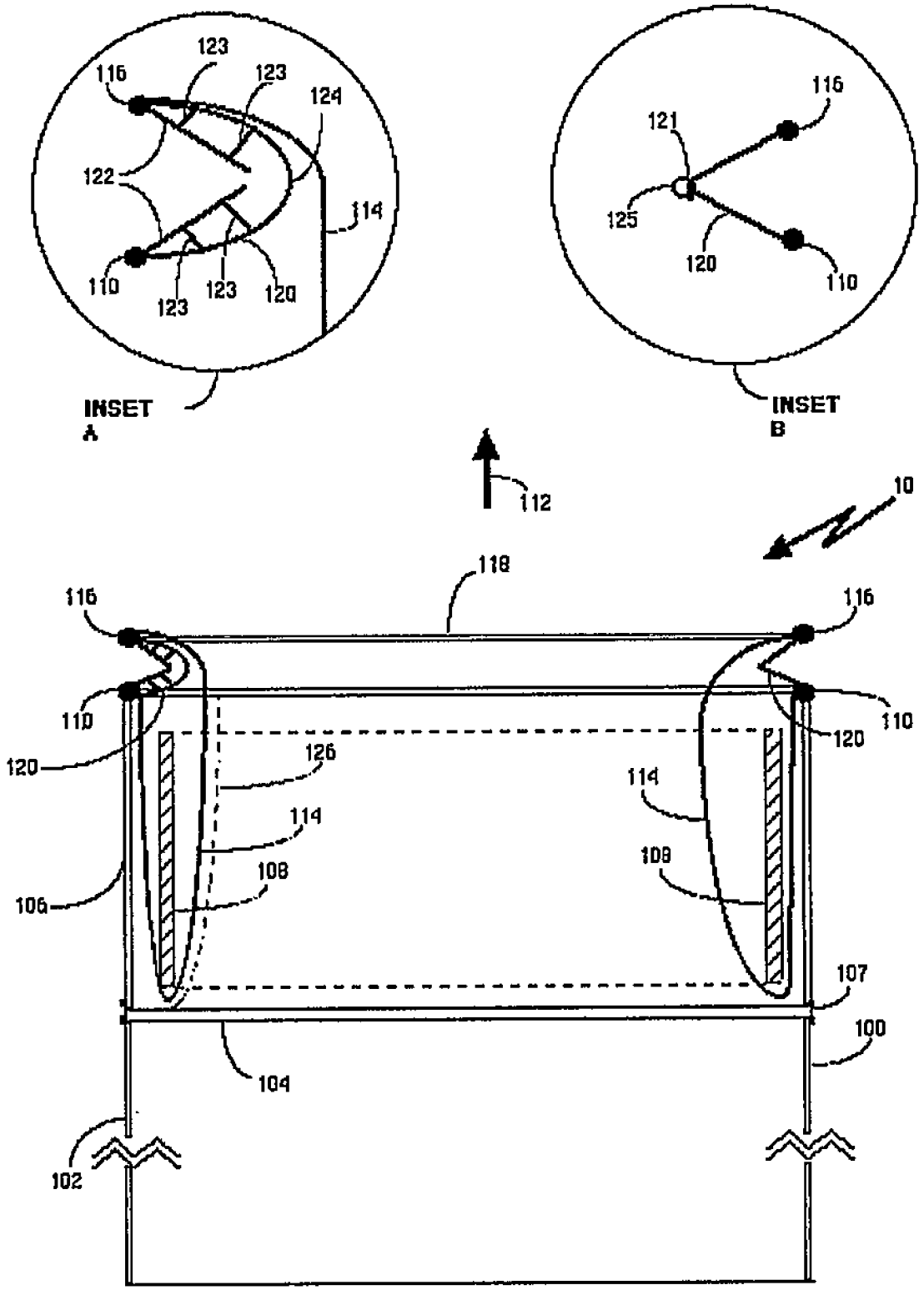
Figure 3:
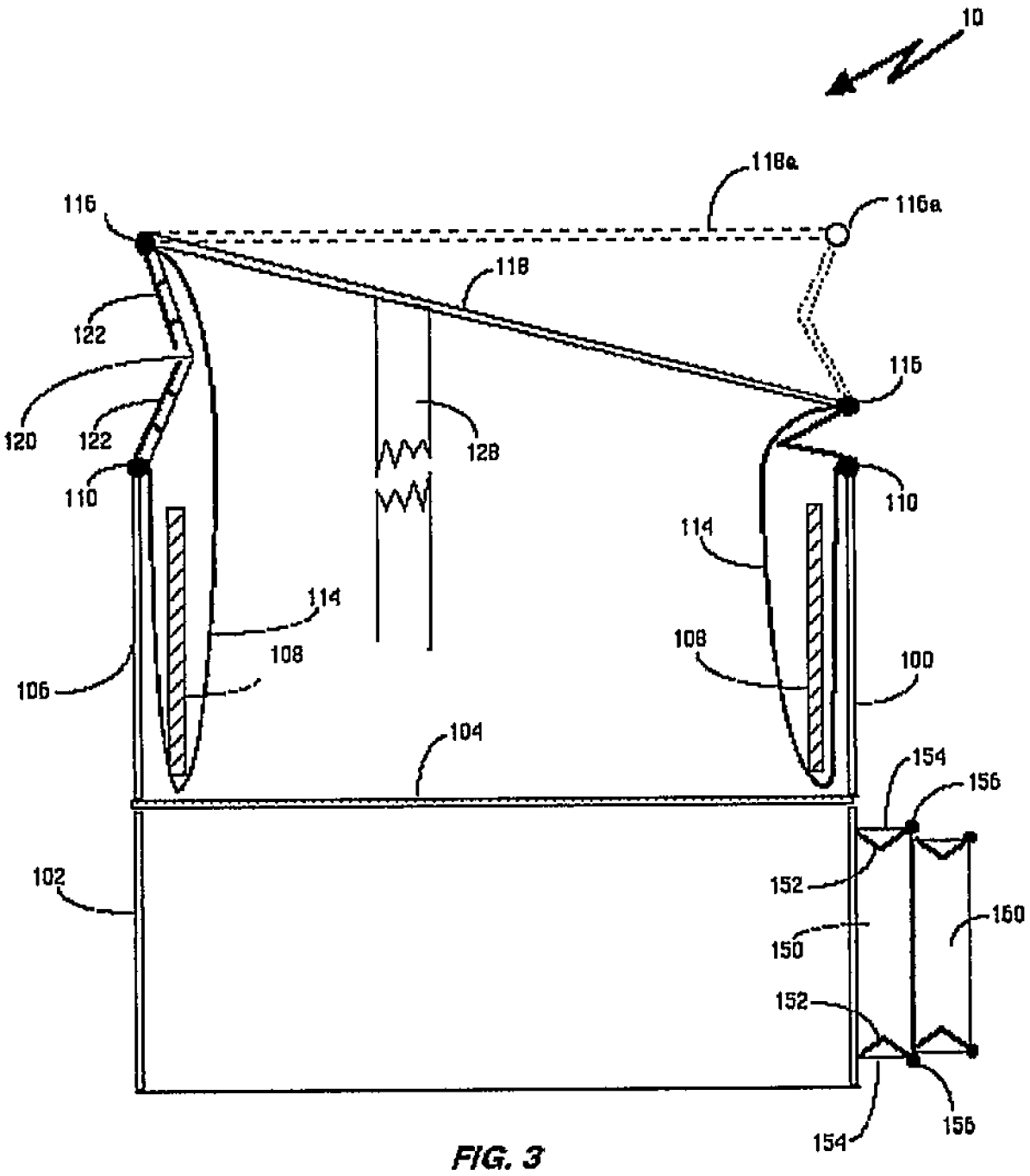
Figure 4:
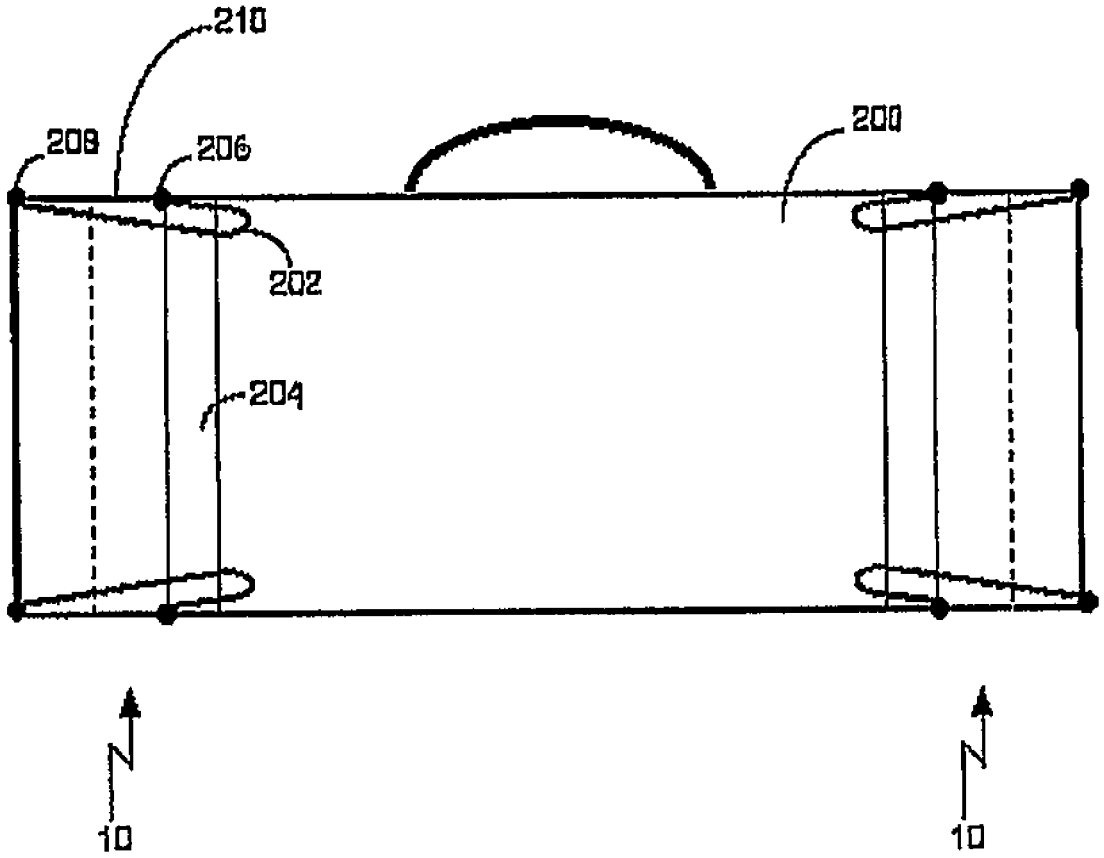
Figure 5:
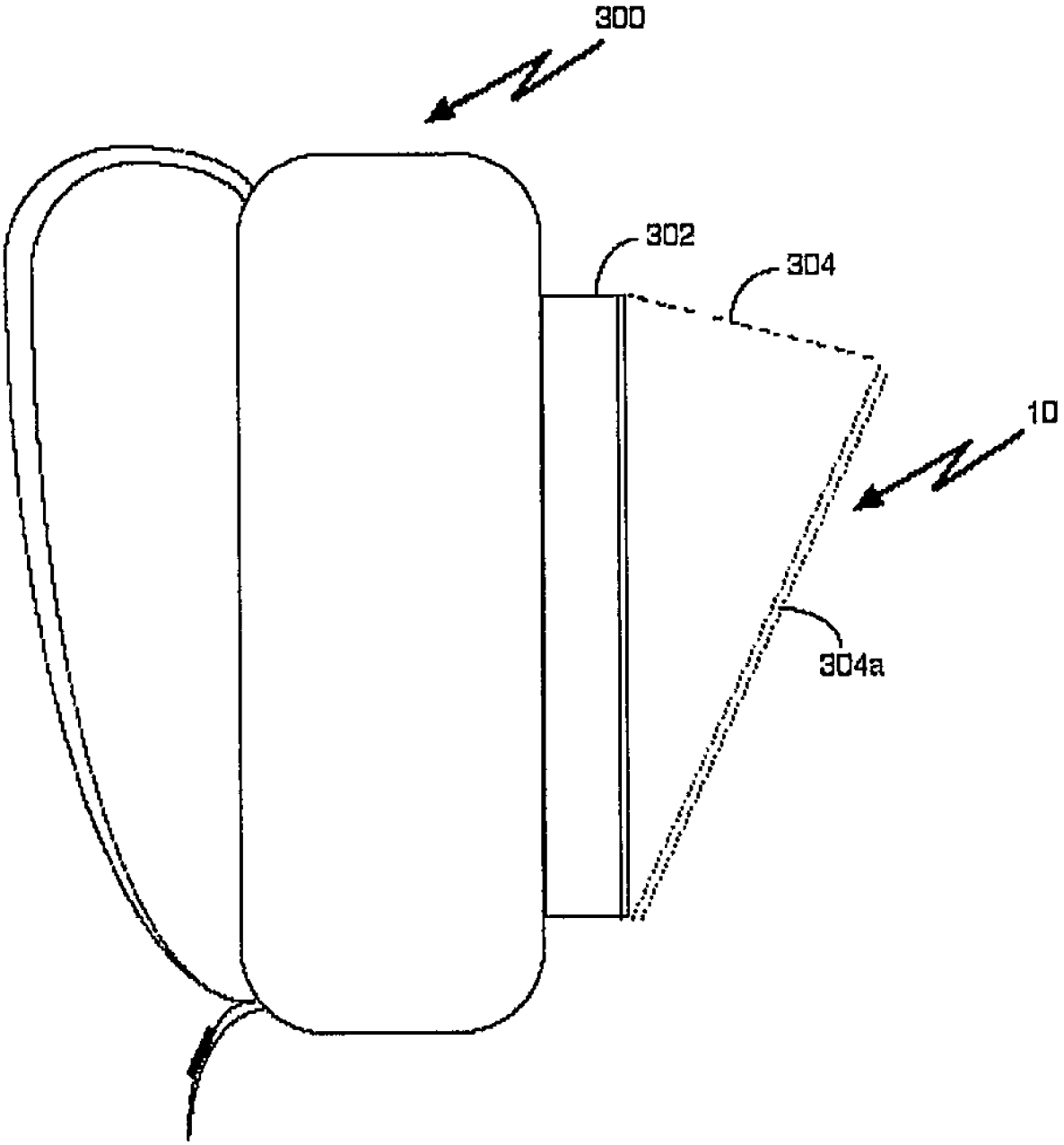
Figure 6:
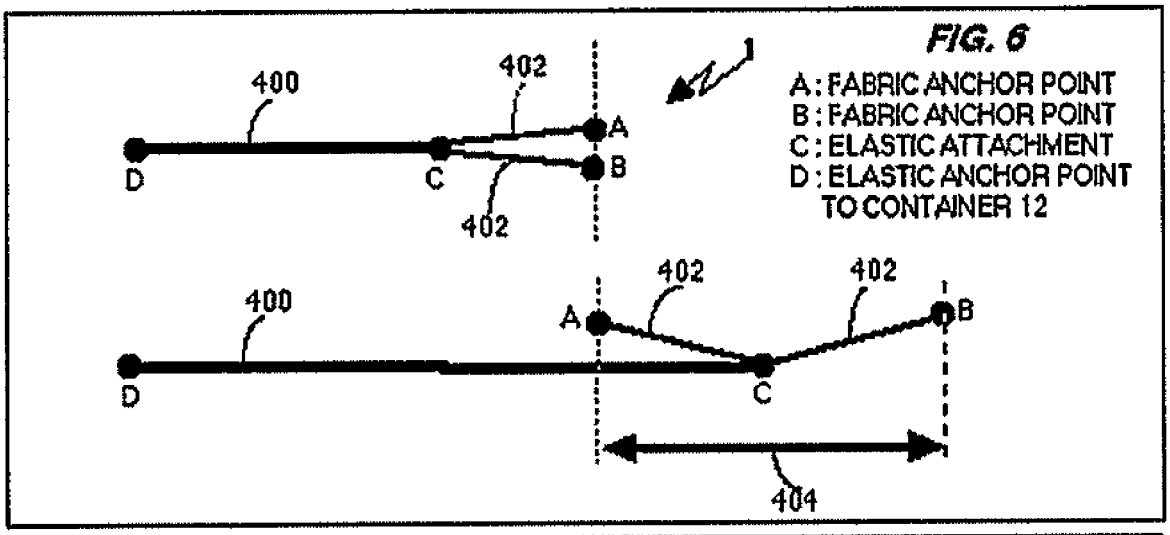
Figure 6A:
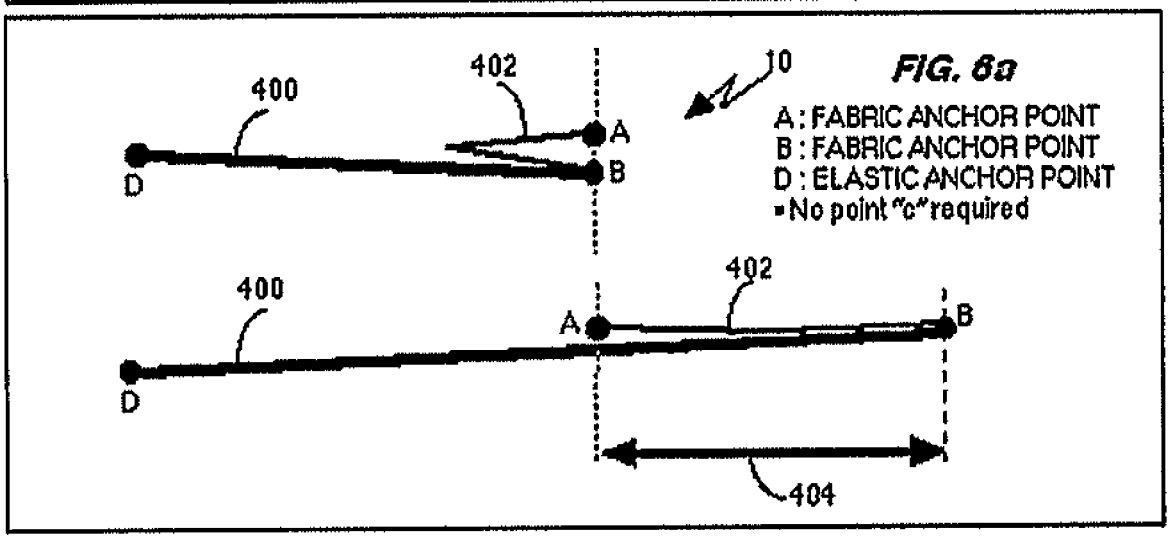
Figure 6B:
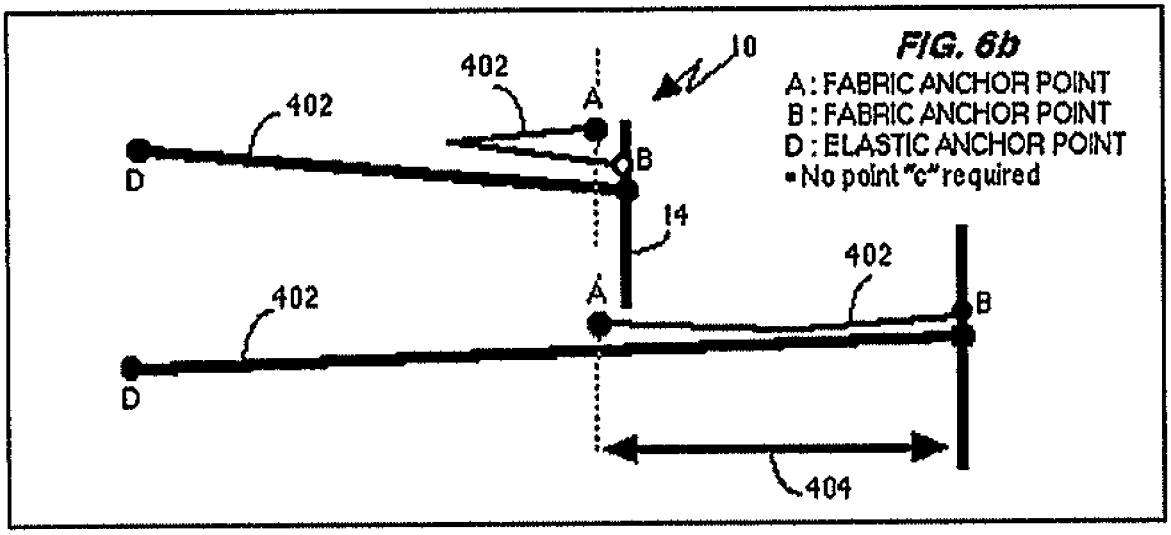
Figure 7:
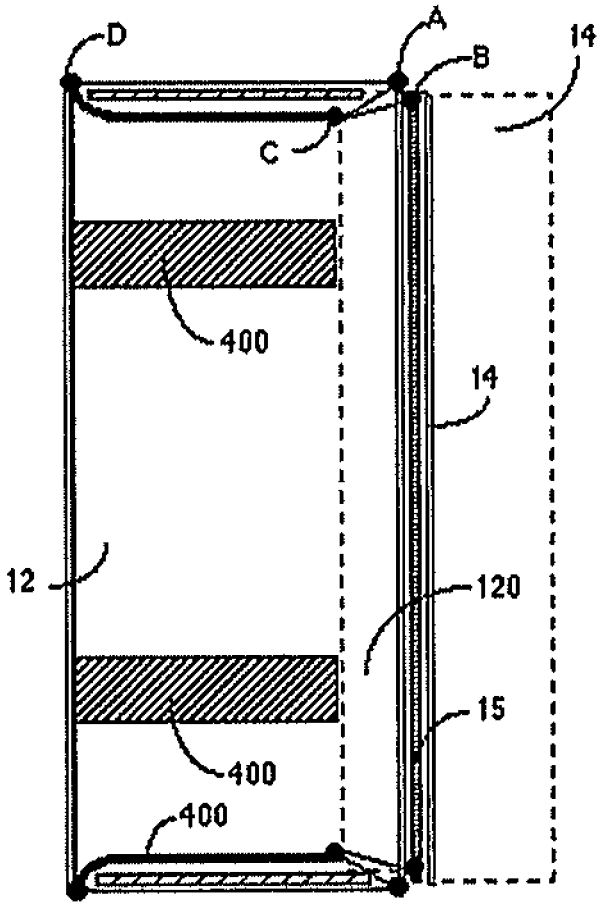
Figure 7A:
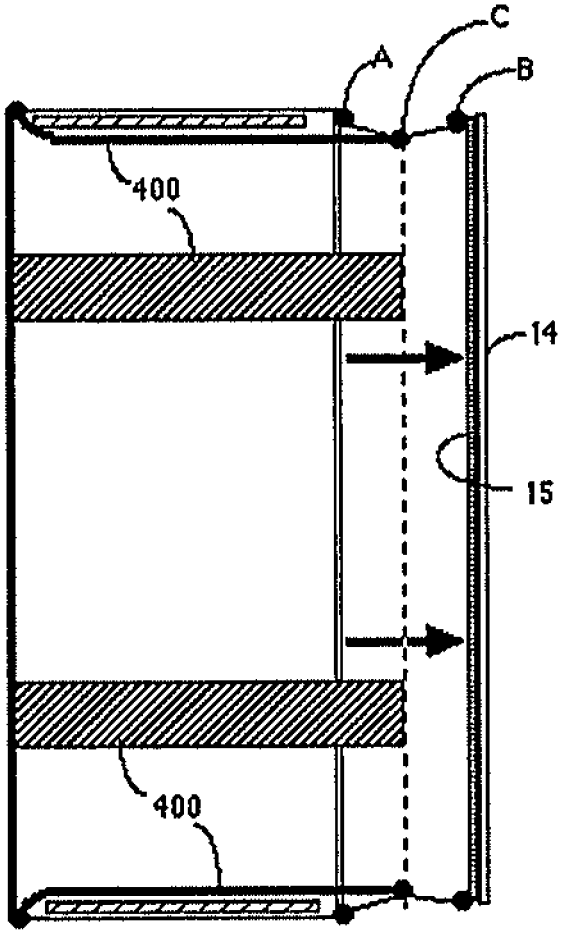
Figure 8:
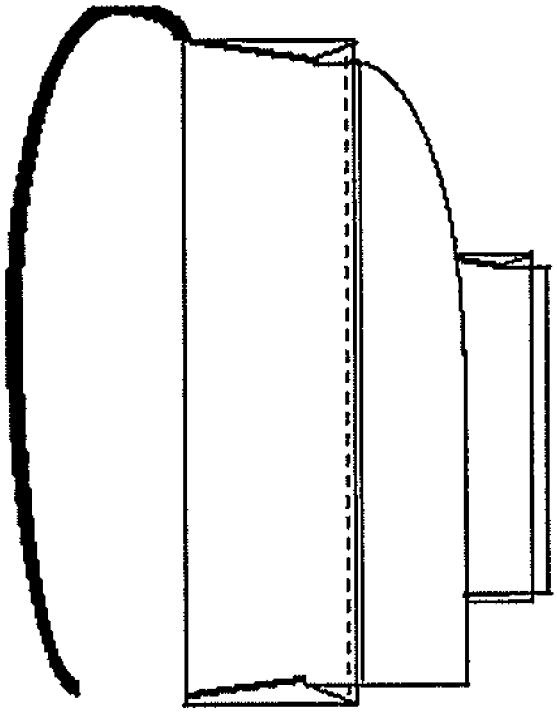
Figure 8A:
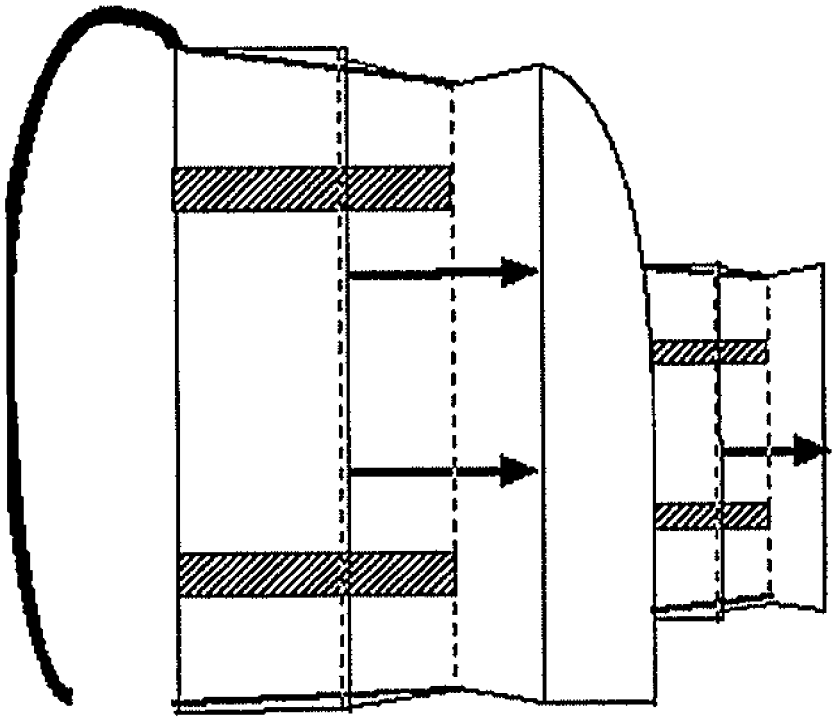
Figure 9:
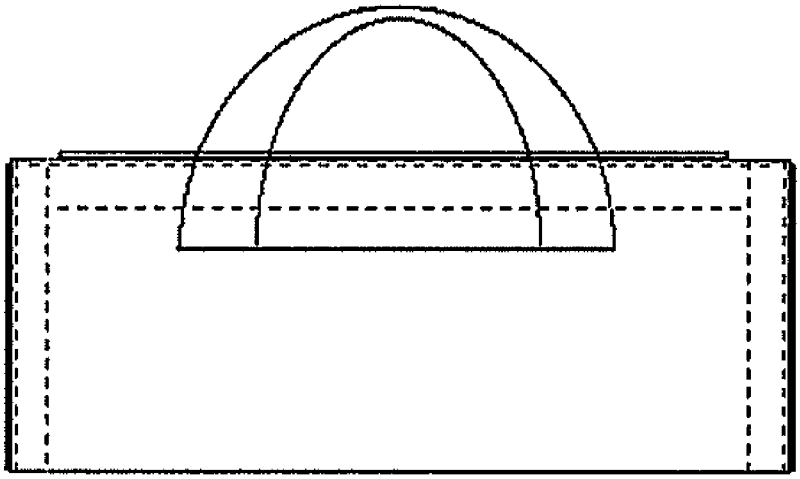
Figure 9A:
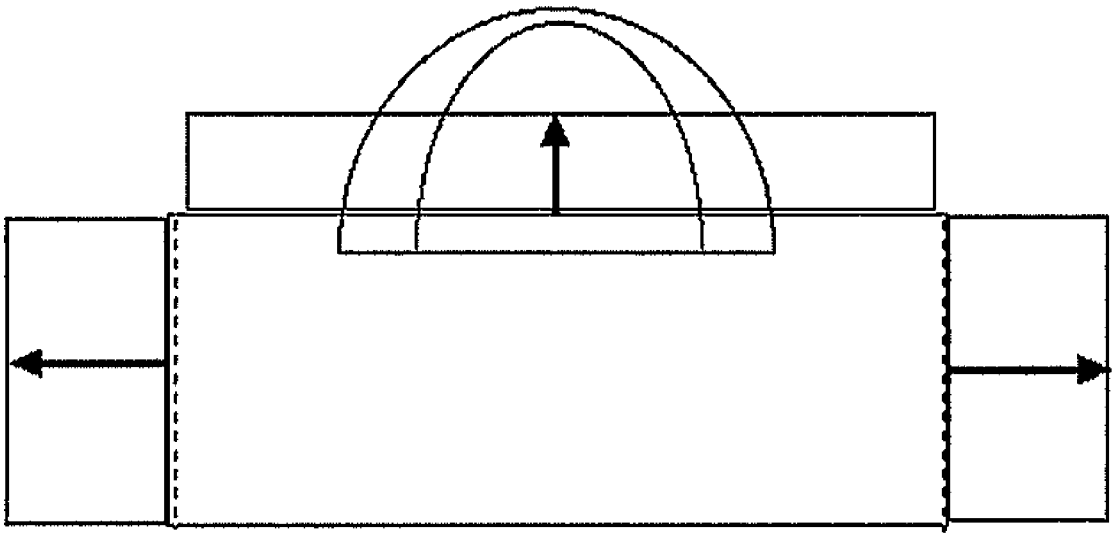
Figure 10:
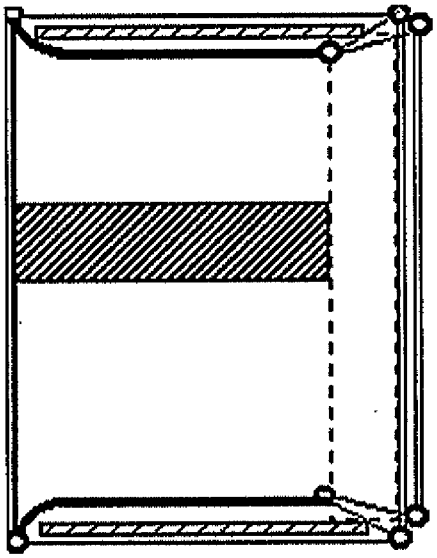
Figure 10A:
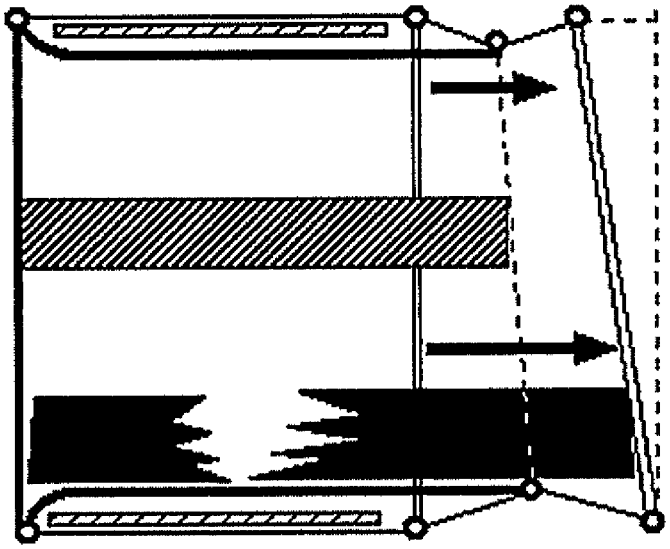
Figure 11:
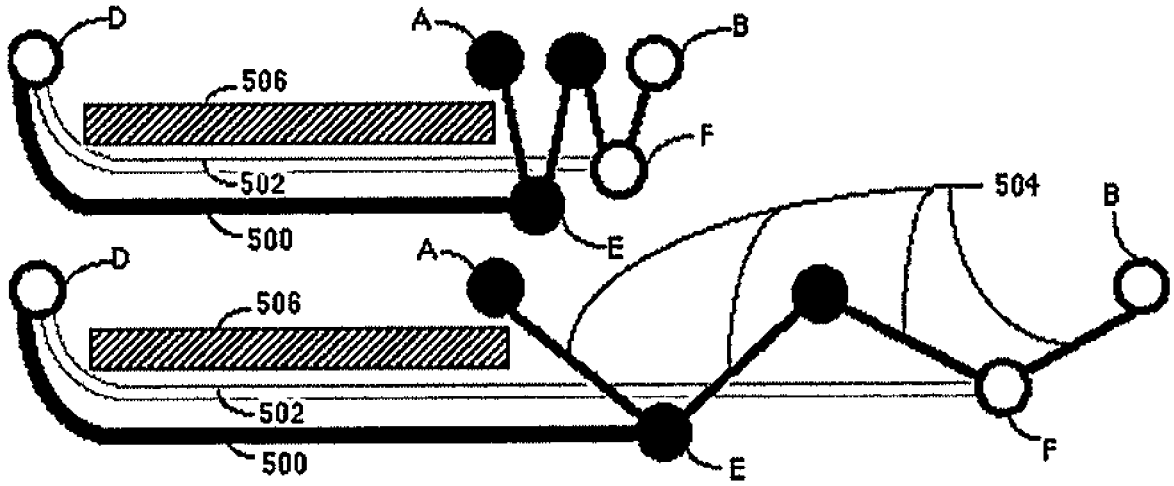
Figure 11A:
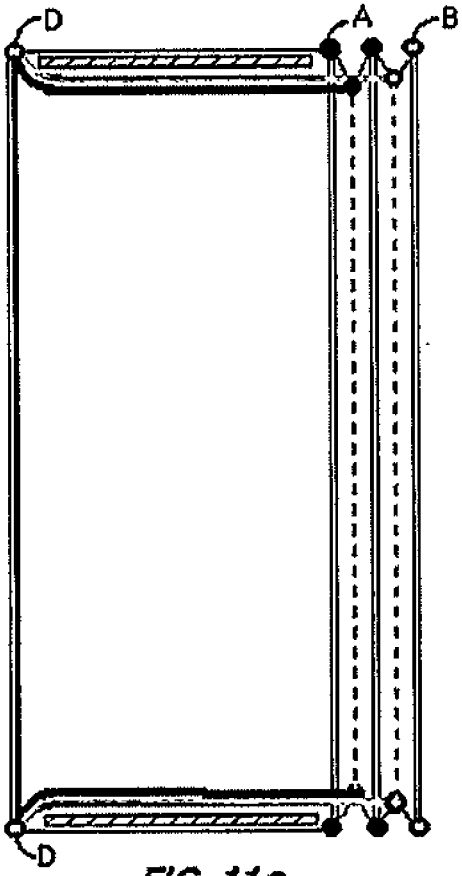
Figure 11B:
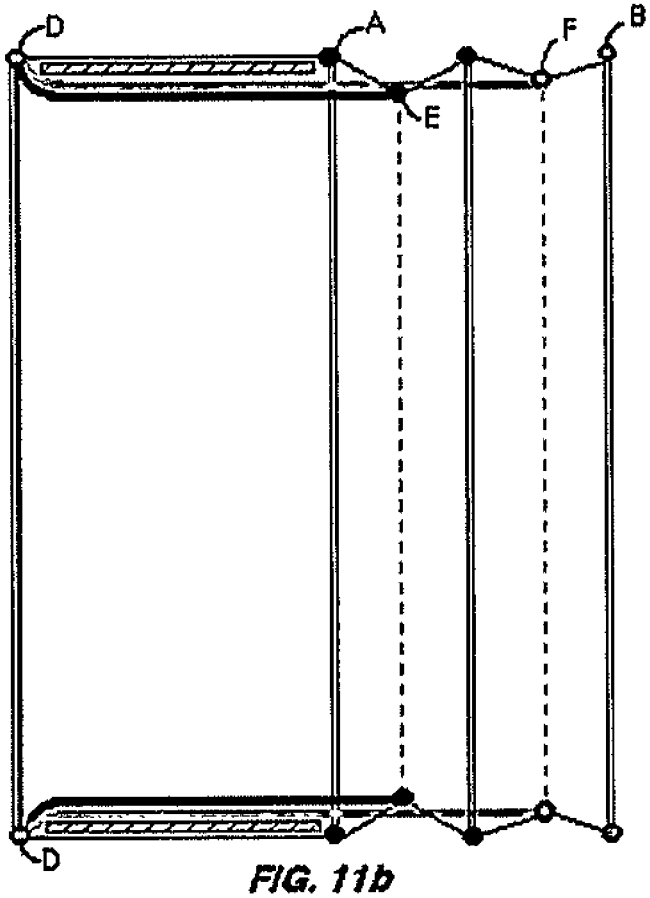

FIGS. 11, 11*a*, and 11*b* show multiple layers of expansion of a single panel utilizing a variation of the method of FIG. 6.

DETAILED DESCRIPTION OF THE INVENTION

Figure 1:
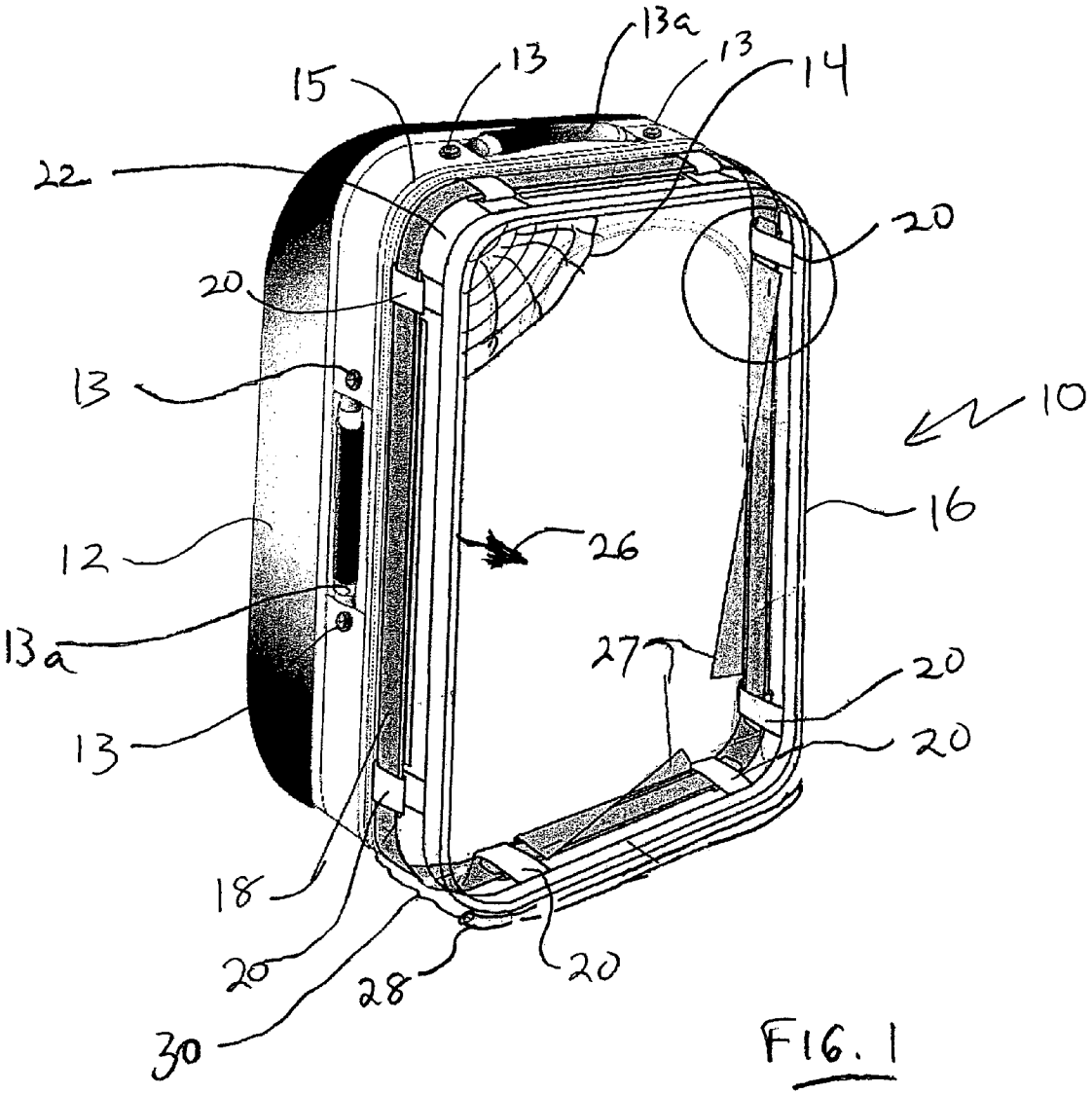
FIG. 1 is a view in perspective of an expandable luggage system.

Referring to FIG. 1 is shown, one embodiment of an expandable luggage system, identified in general by the reference numeral 10, and hereinafter referred to as "the system 10".

The system 10 includes a container 12. The container 12 includes any type of luggage, for example a suitcase (either hard [i.e., rigid] or soft sided [i.e., fabric]) or any type of a briefcase, dufflebag, computer case, carry-on, daypack, backpack, toiletry bag, cosmetic bag, etc.

On at least a portion of one side of the container 12 is provided the system 10 which minimally includes a covering 14 (partially shown).

There are many possible ways of implementing the system 10. One such preferred embodiment includes an expandable perimeter frame structure 16 formed of a substantially rigid material, such as plastic, composite, or metal. This is especially desirable when the container 12 is formed of a rigid material. The container 12, as shown, opens in half along a plane that is provided by opening a first perimeter opening zipper 15.

Carrying handles 13*a* are included and are attached by fasteners 13. The handles 13*a* may extend outward from the inside of the container 12, as is well known in the suitcase and luggage arts. A hinge (not shown) is provided by a section of fabric attached to the far side (i.e., rear) and allows the container 12 to open in half after opening of the first perimeter opening zipper 15, each half of the container 12 being disposed on opposite sides of the first perimeter opening zipper 15. This type of an opening is also well known in the luggage arts whereby the first perimeter opening zipper 15 does not fully encircle the perimeter of the container 12. For a "hard-sided" type of the container 12, actual hinges and latches would be utilized to open and to secure the container 12 closed, as is also well known in the luggage arts, or, alternatively, a section of fabric and the first perimeter opening zipper 15 could be affixed intermediate the two hard-sided portions that open.

The covering 14 is attached around and to the expandable frame structure 16.

A similar fixed frame structure 18 is attached to the container 12. A plurality of elastomeric bands 20 are attached at one end to the fixed frame structure 18 and at an opposite end to the expandable frame structure 16.

As many elastomeric bands 20 as are desired may be used along the perimeter of the frame structures 16, 18.

The covering 14 can be of a hard, rigid material or soft fabric or flexible material, as desired. The covering 14 can include additional pockets (not shown), as desired.

If the container 12 is empty or if it is not filled to excess (i.e., not overflowing), then the elastomeric bands 20 supply a force to urge (i.e., retract) the expandable frame structure 16 and the covering 14 as close as possible to the main body of the container 12 in a direction that is opposite that as shown in a first arrow 26.

If the container 12 is filled to excess so that it cannot be closed without the contents making contact with the two halves before closure can occur, the force exerted on the covering 14 will urge certain or all of the elastomeric bands 20 to expand, thereby permitting the covering 14 to extend away from the container 12 in the direction the first arrow 26.

Nylon folds and inserts 27 are included as desired to add rigidity and ensure that the form is maintained and that all surfaces are smooth and the appearance also maintained. These are also known in the luggage arts and are sometimes referred to as belpolen and as a nylon fix. They are included as desired. Alternatively, one end of each of the elastomeric bands 20 is attached (sewn or otherwise affixed) to the belpolen. The belpolen is enclosed in the nylon fix and secured to the container 12 as part of the fixed frame structure 18. The remaining end of each of the elastomeric bands 20 is then attached to the covering 14 (sewn or otherwise affixed).

For improving both strength and appearance and for retaining shape, a circular tube, known as piping 28 (partially shown) is provided and runs along the entire perimeter. The covering 14 is attached to the piping 28. The opposite end of each of the elastomeric bands 20 may also be attached to the piping 28 or they may be attached to a center fold of an extendible section of fabric 30 (the extendible section of fabric 30 being described in greater detail shortly hereinafter).

Additional piping may also be included adjacent to the fixed frame structure 18 (on the side that does not expand). The additional piping provides a retainer that prevents the fixed frame structure 18 from being pulled outward and away from the container 12 as increased force is exerted upon it by the elastomeric bands 20, as they begin to expand.

Disposed intermediate the expandable frame structure 16 and the fixed frame structure 18 and attached to each is included the extendible section of fabric 30 that encircles the perimeter (if expansion along the entire perimeter is desired) and which retracts inside the container 12 when the system 10 is retracted and extends to the degree required when the system 10 requires expansion and increase of the interior volume of the container 12. This process is described in greater detail below.

A corner section 22 of the extendible section of fabric 30 is also shown. As mentioned above, if expansion of the covering 14 is desired to occur all around the perimeter of the container 12, then the extendible section of fabric 30 must also encircle the perimeter of the container 12 so that as it expands, a sealed and fully enclosed interior volume is always maintained. It is important to note that the magnitude of the interior volume is a variable, one that varies automatically as needed and where needed.

However, if expansion of the covering 14 away from the container 12 is not required to occur all around the perimeter, then the extendible section of fabric 30 need only be included where expansion is desired. If there is a need to accommodate odd shapes of extensions (as described in greater detail hereinafter), then the extendible section of fabric 30 may extend along one-half or one-third (or otherwise) of the overall perimeter length, as is necessary to accommodate the odd shape in question.

Figure 2:
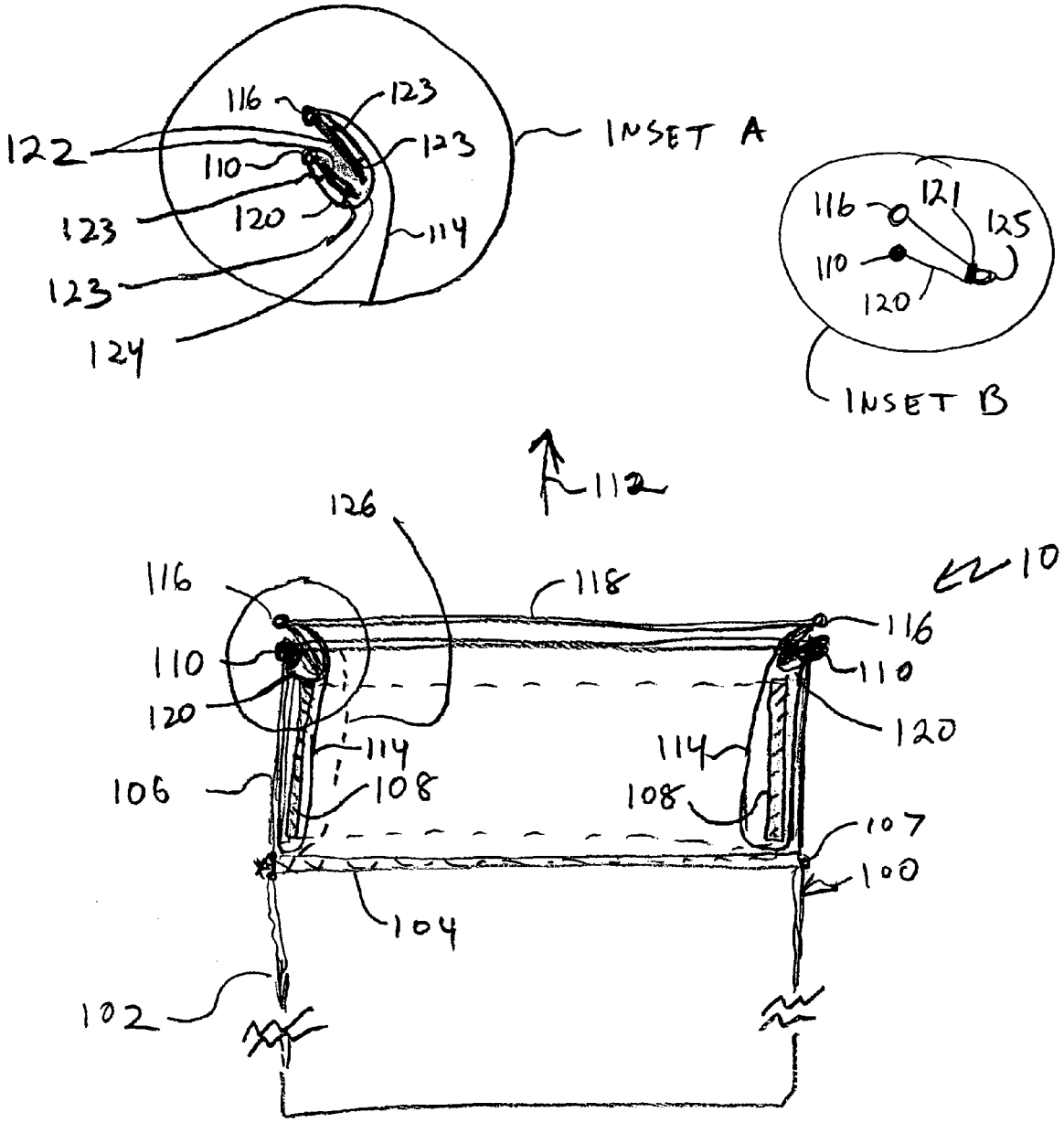
FIG. 2 is a cross-section of a modified container utilizing the expandable luggage system in a closed (retracted) position.

Referring now also to FIG. 2 is shown a cross section of the system 10 as applied to a modified container 100. A lower portion 102 is shown. A zipper 104 encircles the perimeter fully on three sides and partially on the edges of a fourth side (as is well known) and is used to separate and open a top section 106, the non-zipper portion providing a hinge mechanism 107.

A fixed plastic perimeter frame 108 encircles the top section 106. A first piping 110 fully encircles the top section 106 and serves several functions. One is that a top edge of the fixed plastic perimeter frame 108 bears against the fixed plastic perimeter frame 108 and is prevented from being displaced in the direction of a second arrow 112.

In this illustration, the fixed plastic perimeter frame 108 is shown as being disposed more toward the inside of the top section 106 than normal so as to more clearly show other attributes of the system 10. In actual construction, the fixed plastic perimeter frame 108 bears against the outer sidewall fabric of the top section 106 (or other material). Therefore, the first piping 110 prevents it from rising upward when the system 10 is extended as is described in greater detail.

A plurality of modified elastomeric bands 114 are attached at one end to the first piping 110 and pass adjacent to the sidewall fabric of the top section 106 and under the fixed plastic perimeter frame 108. The bands 114 then extend upward along the inside of the top section 106 and are attached at a remaining end thereof to a second piping 116 that extends fully around the perimeter top of a substantially planar end portion 118. The two ends of each bands 114 are sewn to the respective first and second piping 110, 116.

As many bands 114 as desired, of any length, strength, elastic force, spacing, and material are included as desired. For certain applications, very strong bands 114 will augment the functioning whereas for other applications, more readily expandable bands 114 will work better. For example, strong high force bands 114 may be preferred when rigid materials are used and less strong bands 114 may be preferred when fabric materials are used (such as when the container 100 includes an overall soft, fabric construction.

The end portion 118 may be fabric or rigid material, as desired. It may be entirely flat or it may include a curvature, as desired. The purpose of the end portion 118 it to provide an expandable end that also provides a seal for the remaining end of the modified container 100.

Attached to the first and second piping 110, 116 and extending intermediate the first and second piping 110, 116 is an extendible section of fabric 120 that fully surrounds the perimeter. The extendible section of fabric 120 is of sufficient length to encircle the container 100 along the piping 110, 116. It includes a preferred width to allow for the desired amount of expansion and it works in cooperation with the elastomeric bands 114.

Refer momentarily to Inset A of FIG. 2 for added detail. The extendible section of fabric 120 passes around a pair of optional hinged plastic members 122 that are attached (sewn) to the extendible section of fabric 120 with stitches 123. The hinged plastic members 122 are provided in pairs that are in parallel alignment with each other and are sewn to the extendible fabric 120. The elastomeric bands 114 pass over the extendible section of fabric 120 and over the hinged plastic members 122 on the inside of the container 100.

The plastic members 122 are but one way of ensuring that the extendible section of fabric 120 will fold inward, however, they are not the only way. There are many ways of ensuring that the fabric folds inward, certain of which are discussed hereinafter.

When the end portion 118 is retracted, as shown in FIG. 2, the hinged plastic members 122 provide a hinge mechanism that helps to ensure that the extendible section of fabric 120 always folds inward into an interior of the container 100. When closed (retracted) the first and second piping 110, 116 are brought into contact with each other along the perimeter, thereby providing a smooth appearance to the container 100 when the expandable benefits of the system 10 are not required.

A small space 124 of the extendible section of fabric 120 intermediate the hinged plastic members 122 extends for the length of the hinged plastic members 122 and it develops a crease after manufacture that also helps ensure that the extendible section of fabric 120 will always fold inward. The hinged plastic members 122 are typically used on all four sides for this purpose. They may be of any length and more or less may be used, as desired.

Another way of ensuring that the extendible section of fabric 120 will fold inward is to provide a stitch fold in the fabric 120 as shown in Inset B. The stitch fold includes a section of the extendible section of fabric 120 that is folded over onto itself where a manufactured crease 125 is desired. A length of stitching 121 is run along a portion of the longitudinal length thereby sewing the fabric 120 to itself and providing the built-in manufactured crease 125. Accordingly, whenever the extendible section of fabric 120 is retracted, the stitch fold ensures that the fabric 120 will fold in a direction that corresponds with the crease 125 that has been created.

A lining 126 (shown only in part and in dashed lines) is provided on the inside all around, as desired, to conceal the component parts of the system 10 as well as to protect them from contact with any items placed in the container 100. The lining 126 may include another zipper for access or any method of attachment to the top section 106 as desired.

Referring to FIG. 3, is shown the container 100 with an oversized object 128 placed on one side of the container 100. As can be seen, the elastomeric band(s) on the one side have stretched to accommodate the object 128. The second piping 116 has been displaced away from the first piping 110 on the one side as well. The extendible section of fabric 120 has been drawn out from the inside of the container 100 and has extended to automatically provide the required increase in volume in the container 100 when the top section 106 was closed (i.e., when the top section 106 is urged toward the lower section 102 or when the zipper 104 is closed).

It is noted that only as much extension as needed is provided and that this extension is provided automatically upon closing. It is also noted that the extension occurs only in those areas that are required. Accordingly, the remaining of any contents (not shown) are held with optimum closure (i.e., tightness, snugness, or lack of excessive space). This provided optimum safe containment and transport of the contents, which if they were too loose as would occur with prior art designs that are unzipped and fully extend, would be in danger of excessive movement within the container 100 and possible damage.

Accordingly, the end portion 118 is disposed at an angle when the container 100 is closed. Any and all portions of the container 100 can automatically expand to the extent needed, with different amounts of expansion occurring at different perimeter locations, as needed. Of course, the width of the extendible section of fabric 120 and the elastomeric capacity of the elastomeric bands 114 limit the amount of expansion that the system 10 can provide.

If the container were overstuffed in a more even fashion the right side would accomplish this need for an even and uniform increase in volume as shown by a right side raised piping 116*a* and end portion 118*a* (dashed lines).

Referring to the lower portion 102 on the right is shown a first extendible pocket 150 that includes a perimeter of extendible fabric 152 and a plurality of small stretch bands 154 that are attached to the lower portion 102 and to a perimeter piping 156. Access to the first pocket 150 is provided by a pocket zipper (not shown) or flap (not shown) as is well known. This view of the system 10 as applied to the first pocket 150 is simplified for clarity and would typically include certain of the components as previously described.

The first pocket 150 shows how the system 10 can be applied in a plurality of locations to the container 100 whereby automatic expansion of the container is accomplished in more than one direction at the same time.

A second pocket 160 that is constructed similar to the first pocket 150 is provided and is smaller than the first pocket 150 and is attached to an outer portion thereof. The second pocket 160 on top of the first pocket 150 show how the system 10 can be layered, as many times as desired, on top of the other to provide virtually unlimited expansion capabilities.

Referring now to FIG. 4 is shown a dufflebag container 200 having a generally tube-like shape with the system 10 provided on parallel opposite ends thereof. Elastomeric bands 202 pass around an interior frame 204 and attach to piping 206, 208. An extendible fabric 210 is shown stretched (fully extended). The system 10 repeats on opposite ends. This shows how the system 10 can be used to extend opposite and parallel ends of the dufflebag (or other type) container 200.

FIG. 5 shows a backpack 300 with the system 10 in a special pocket 302 that has a shape that accommodates the shape of an accessory item placed therein. Accordingly, if this shape is predicable and if the accessory item is either carried in the special pocket 302 or it is not, then a modified extendible section of fabric 304 (dashed lines) can be cut to match that shape and automatically expand to suit 302*a* (dashed lines) when the item is in the special pocket 302 and retract flush when it is not. Accordingly, any expansion shape or profile is attainable. Of course, the elastomeric bands (not shown in this illustration) would be adjusted as well to allow for a greater degree of expansion where it is required and a lesser degree of expansion wherever a lesser degree of expansion is required.

Referring now to FIGS. 6, 6*a*, and 6*b* are shown various simplified cross sections of attachment of the system 10 including a modified elastomer 400 in both a retracted position (on top) and an expanded position (on the bottom) of each of the drawing figures.

A common point of attachment of the modified elastomer 400 to the container 12 (not shown in these figures) is represented by the letter "D" and is intended to include any location in the container 12 that does not expand.

A modified section of extendible fabric 402 is similarly shown, the modified section of extendible fabric 402 including a first fabric anchor point "A" that is attached to that portion of the container 12 that does not expand. A second fabric anchor point "B" includes an opposite end of the modified extendible fabric 402 that is adapted to retract toward the container 12 or expand away from it.

Referring now to FIG. 6, the modified elastomer 400 includes an opposite end "C" that is attached to a center (or intermediate) location of the modified extendible fabric 402. As is shown, the modified elastomer 400 is capable of automatically stretching from the retracted "C" position (on top of FIG. 6) to the extended "C" position (on the bottom of FIG. 6) and of automatically retracting the second anchor point "B" back toward the container 12 when the expansion is no longer required.

The method shown in FIG. 6 provides yet an additional method of helping to ensure that the fold is drawn into toward the interior of the container 12, thereby adding to the aesthetics of the system 10.

An arrow 404 represents the length (amount) of expansion that is attainable. It is important to note that this amount of expansion (for FIGS. 6, 6*a*, and 6*b*) can occur along a portion of the length of the perimeter of the container 12 or along the entire length of the perimeter, as desired and depending also upon the construction (i.e., whether or not the system 10 extends around the entire perimeter or only a portion of the perimeter).

Referring now to FIG. 6*a*, the modified elastomer 400 includes an opposite end that is attached to the second fabric anchor point "B". As is shown, the modified elastomer 400 is capable of automatically stretching from the retracted "B" position (on top of FIG. 6) to the extended "B" position (on the bottom of FIG. 6) and of automatically retracting the second anchor point "B" back toward the container 12 when the expansion is no longer required.

Referring now to FIG. 6*b*, the modified elastomer 400 includes an opposite end that is attached to the covering 14 (as shown in FIG. 1) proximate to the second fabric anchor point "B" (which is also attached to the covering 14). As is shown, the modified elastomer 400 is capable of stretching from the retracted "B" position (top FIG. 6) to the extended "B" position (bottom FIG. 6) and of automatically retracting the second anchor point "B" back toward the container 12 when the expansion is no longer required.

Referring now to FIGS. 7 and 7*a* is shown a single expansion application utilizing the method of FIG. 6 for the retraction of the extendible section of fabric 120. As can be seen, the modified elastomers 400 (not all shown) urge the center fold location "C" (i.e., the crease area) of the extendible section of fabric 120 toward an interior of the container 12.

The zipper 15 is used to access the interior of the container 12, as has been previously described. The covering 14 acts as a hinged door or "lid" as it sometimes referred to in the luggage industry. The covering 14 works in cooperation with the zipper 15 to provide access to the interior of the container 12. When the zipper 15 is unzipped (it does not fully encircle the container 12) the remaining section of flexible material that is on the same plane and is disposed intermediate the two ends of the zipper 15 acts as a hinge, as was also previously described.

However, FIG. 7 also shows in dashed lines the covering 14 after the zipper 15 has been unzipped and the covering 14 has been swung around its hinge into a near fully open position. It is important to note that in this open position (with the covering 14 open to allow full access to the interior of the container 12) certain desirable conditions arise.

"A" and "B", as shown, will typically include and therefore represent cross-sections of piping. First, the second piping (represented by "B" [FIG. 6]) is pulled by the elastomers 400 into contact with the first piping (represented by "A") all along the perimeter of the container 12. FIG. 6 shows "B" being pulled to a location that is somewhat inward of "A". FIG. 7 shows "B" being pulled not quite as much inward of "A".

Depending on design modifications to any of the component parts, it is possible for "B" to be either pulled directly over "A", inside of "A", or even outside of "A".

For example, if the covering 14 panel is made with a larger width and length than that of the container 12 at location "A", when contracted "B" will be disposed outside with respect to "A" (because the perimeter of "B" will exceed that of "A". If the opposite is true, then "B" will have a smaller perimeter than "A" and be disposed inside of "A" when the system 10 is in the contracted or retracted position. If the dimensions are the same, then "B" will tend to be drawn directly over "A".

This is discussed to illustrate how that actual implementation of the methods of FIG. 6 will produce variations in the final product, as desired. A substantial aesthetic benefit is also attained.

Each of the pipings at "A" and "B" encircle the perimeter of the container 12. When the expandable luggage system 10 is disposed in the retracted position (i.e., when its expansion benefits are not needed), the piping at "B" is urged (by the elastomers 400) into a position that is adjacent to the piping at "A". This occurs all around the container 12.

This (having one piping adjacent to the other when the system 10 is in the retracted position) provides a neat, smart appearance, one that hides any indication of the presence or benefit of the expandable luggage system 10. Instead of detracting from the appearance of the container 12, the expandable luggage system 10 actually adds to its appearance in that the two adjacent layers of piping (A and B) that encircle the container 12 are attractive and make the container appear to be a higher quality type of product.

Another benefit provided is that when the covering 14 is open, the elastomers 400 do not extend up beyond the contracted sides of the container 12. Therefore, the elastomers 400 do not interfere with anything that is placed inside of the container 12. For some applications, a lining will be disposed around the inside sides of the container 12. The lining will cover the elastomers so that they will not even be visible. When the lining is used, presence of the expandable luggage system 10 will be difficult, for even a person skilled in the art, to detect.

Assuming now that the covering 14 is open (as shown with dashed lines in FIG. 7) and that the container 12 is open for filling. Assume also that the container 12 has been overstuffed, that is it is has been filled to a depth that exceeds the distance from "A" to "B" when the expandable luggage system 10 is retracted, as shown in FIG. 7. How is is possible to get from the overstuffed condition of FIG. 7 to a closed and extended position for the expandable luggage system 10 as shown in FIG. 7*a*?

There are two basic ways of stretching the elastomers 400 as much as is required into the extended position. The first is simply to close the zipper 15. As the zipper 15 is drawn closed, it attempts to pull the inside edge of the covering 14 (that is disposed on one side of the zipper 15) to a position that is adjacent to the second piping "B" (that is disposed on the opposite side of the zipper 15).

But this cannot happen if the system 10 remains in a retracted position because of the overstuffed condition. Therefore, as the zipper 15 is forced to close, the elastomers 400 stretch as much as required to extend the second piping "B" until the zipper 15 is fully closed and the condition as shown in FIG. 7*a* is attained.

This is a substantial improvement over the prior art. The container 12 is opened, overstuffed, and closed normally with the zipper 15 (albeit with more force having to be applied to the zipper 15 to close a significantly overstuffed container 12). Expansion to accommodate the overstuffed condition occurs automatically and only to the extent that is necessary.

The other basic method to close an overstuffed container 12 is, with one hand, to pull outward on point "B" proximate where the actual zipping is taking place and then draw the zipper 15 closed until resistance begins to increase. Then the one hand is moved to the next location grasping and pulling outward again on point "B" while continuing the process of closing the zipper 15 until the container 12 is fully closed. This variation makes for easier drawing of the zipper 15. The net effect for both closure methods is as shown in FIG. 7*a*.

Referring now to FIGS. 8 and 8*a* is shown a double expansion application for a modified backpack utilizing the method of FIG. 6.

Referring now to FIGS. 9 and 9*a* is shown a multiple expansion application with expansion in three directions utilizing any of the methods of FIGS. 6, 6*a*, or 6*b*. The luggage shown includes a duffel bag or other type of luggage as desired.

Referring now to FIGS. 10 and 10*a* is shown an uneven expansion of a single panel utilizing the method of FIG. 6.

Referring now to FIG. 11 is shown a cross-section of a multiple expansion concept for the system 10 whereby a method is provided for incorporating any number of expansions that occur in the same direction and which maintain, substantially, the same size (i.e., length and width) of the expanding area as the multiple expansions occur.

Attached to the common point of attachment "D" (as was described above regarding FIG. 6) is a first elastomer 500 and a second elastomer 502. For each occurrence, the second elastomer 502 may be disposed adjacent to the first elastomer 500 or it may be offset to the side to prevent interference.

An opposite end of the first elastomer 500 is attached to an opposite end "E" that includes (i.e., is attached to) a first center (or intermediate) location of a second modified extendible fabric 504. An opposite end of the second elastomer 502 is attached to an opposite end "F" that includes (i.e., is attached to) a second center (or intermediate) location of the second modified extendible fabric 504. If desired, the second modified extendible fabric 504 could be extended to have additional center locations thereby providing as much expansion as desired.

This is a variation of the method described in FIG. 6, where instead of the one location "C" for attachment of the elastomer 400 of FIG. 6, multiple center locations "E" and "F" are provided, one for each elastomer 500, 502. Accordingly, two folds are provided for the second modified extendible fabric 504.

A cross-section of a frame member 506 is shown. The frame member 506 secures the common point of attachment "D" to the main body of the container, thereby keeping it from being drawn in the direction of the expansion. The frame member 506 also limits the amount of retraction that can occur for locations E and F of the second modified extendible fabric 504.

Referring now to FIG. 11*a* is shown the modified system 10 of FIG. 11 in a retracted position.

Referring now to FIG. 11*b* is shown the modified system 10 of FIG. 11 in an extended position.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An expandable luggage system, comprising:

(a) a container having a predetermined shape and size (b) at least one extendible section;

(c) means for retracting said at least one extendible section attached to said container wherein a force that is adapted to urge said at least one extendible section in a direction that is toward said container is applied by said means for retracting; and including an extendible section of material that is disposed intermediate said extendible section and said container, and wherein said section of material includes a fabric, and including a first piping applied around a perimeter of said container and a second piping applied to a perimeter of said extendible section and including a plurality of elastomeric bands, each of said bands attached at one end thereof to said first piping and to said second piping at an opposite end thereof.

2. The expandable luggage system of claim 1 wherein said container includes an article of luggage.

3. The expandable luggage system of claim 1 wherein said means for retracting includes an elastomer.

4. The expandable luggage system of claim 3 wherein said elastomer includes a plurality of elastomeric bands, each of which is attached at one end thereof to a portion of said container and to said extendible section at an opposite end thereof.

5. The expandable luggage system of claim 1 including means for retracting said extendible section of material into an interior of said container when said extendible section is disposed in a retracted position.

6. The expandable luggage system of claim 5 wherein said means for retracting includes providing at least one hinge mechanism that is attached to said material and is adapted to fold into said container.

7. The expandable luggage system of claim 6 wherein said hinge mechanism includes two plastic members that are in parallel alignment with each other and which are each attached to said material including a longitudinal space therebetween, said longitudinal space of material providing for a predicable location of flexing for said hinge mechanism.

8. The expandable luggage system of claim 1 wherein said container includes a rigid material.

9. The expandable luggage system of claim 1 wherein said container includes a flexible material.

10. The expandable luggage system of claim 1 wherein a plurality of said expandable luggage systems are included with the same container.

11. The expandable luggage system of claim 10 wherein said plurality of expandable luggage systems are disposed on different surfaces of said container.

12. The expandable luggage system of claim 10 wherein said plurality of expandable luggage systems are disposed on the same surface of said container.

13. The expandable luggage system of claim 12 wherein said plurality of expandable luggage systems are disposed one atop the other.

14. A method for increasing an interior volume of a luggage, comprising the steps of:

(a) providing a container having a predetermined shape and size and including at least one extendible section of fabric attached thereto and including means for applying a first force to said at least one extendible section attached to said container and wherein said first force is adapted to urge said at least one section in a direction that is toward said container into a retracted position, and including an extendible section of material that is disposed intermediate said extendible section and said container, and wherein said section of material includes a fabric, and including a first piping applied around a perimeter of said container and a second piping applied to a perimeter of said extendible section and including a plurality of elastomeric bands, each of said bands attached at one end thereof to said first piping and to said second piping at an opposite end thereof;

(b) filling said container with at least an aggregate of objects that include a volume which is greater than that of said container when said container is disposed in said retracted position; and (c) applying a second force to a portion of said container sufficient to close said container and wherein said second force is sufficient to overcome said first force and to cause at least a portion of said extendible section to be displaced in a direction that is away from said container and into an expanded position.

* * * * *

UNITED STATES PATENT AND TRADEMARK OFFICE

CERTIFICATE OF CORRECTION

PATENT NO. : 7,021,437 B2
APPLICATION NO. : 10/608936
DATED : April 4, 2006
INVENTOR(S) : Ghiassi It is certified that error appears in the above-identified patent and that said Letters Patent is hereby corrected as shown below:

The title page showing the illustrative figure should be deleted and substitute with the attached title page.

The drawing sheet, consisting of Fig. 1 – 11b, should be deleted and replaced with drawing sheet, consisting of Fig. 1 – 11b, as shown on the attached page.

Signed and Sealed this

Fourth Day of December, 2007

JON W. DUDAS
*Director of the United States Patent and Trademark Office*

(12) United States Patent
Ghiassi

(10) Patent No.: US 7,021,437 B2
(45) Date of Patent: Apr. 4, 2006

(54) EXPANDABLE LUGGAGE SYSTEM

(76) Inventor: Mohssen Ghiassi, 62 Rancheria Rd., Kentfield, CA (US) 94904

( * ) Notice: Subject to any disclaimer, the term of this patent is extended or adjusted under 35 U.S.C. 154(b) by 295 days.

(21) Appl. No.: 10/608,936

(22) Filed: Jun. 27, 2003

(65) Prior Publication Data

US 2004/0262111 A1 Dec. 30, 2004

(51) Int. Cl.
*A45C 7/00* (2006.01)
*A45C 13/26* (2006.01)

(52) U.S. Cl. ..... 190/103; 190/22; 190/126; 190/127; 383/2

(58) Field of Classification Search ..... 190/103–105, 190/126, 14, 21, 22, 127; 383/2
See application file for complete search history.

(56) References Cited

U.S. PATENT DOCUMENTS 1,341,099 A * 5/1920 Abramson ..... 190/103
3,321,053 A * 5/1967 Doppelt ..... 190/104
3,443,671 A * 5/1969 Dyke ..... 190/103
3,480,118 A * 11/1969 Dyke ..... 190/103
3,523,595 A * 8/1970 Dyke ..... 190/103
4,128,150 A * 12/1978 Popkin et al. ..... 190/103
4,312,431 A * 1/1982 Corey ..... 190/104
4,366,886 A * 1/1983 Tawil ..... 190/103
4,773,515 A * 9/1988 Kotkins, Jr. ..... 190/103
5,080,206 A * 1/1992 Tawil ..... 190/103
5,252,161 A * 10/1993 Chang et al. ..... 156/196
6,053,382 A * 4/2000 Wyant ..... 224/153
6,220,411 B1 * 4/2001 Sciclune et al. ..... 190/103

* cited by examiner

*Primary Examiner*—Sue A. Weaver
(74) *Attorney, Agent, or Firm*—Risto A. Rinne, Jr.

(57) ABSTRACT

An apparatus for the containment of objects includes a container having at least one expandable portion that includes an expandable surface and a plurality of elastomers connected to the container and to the expandable portion that normally supplies a force to the expandable surface to retract it toward the container. When the objects exceed the normal volume in the container and the container is closed, the elastomers expand where needed and to a minimum extent as needed sufficient to accommodate the objects. When the objects do not exceed the normal volume and the container is closed, the elastomers automatically retract the expandable portion into a retracted position.

14 Claims, 11 Drawing Sheets

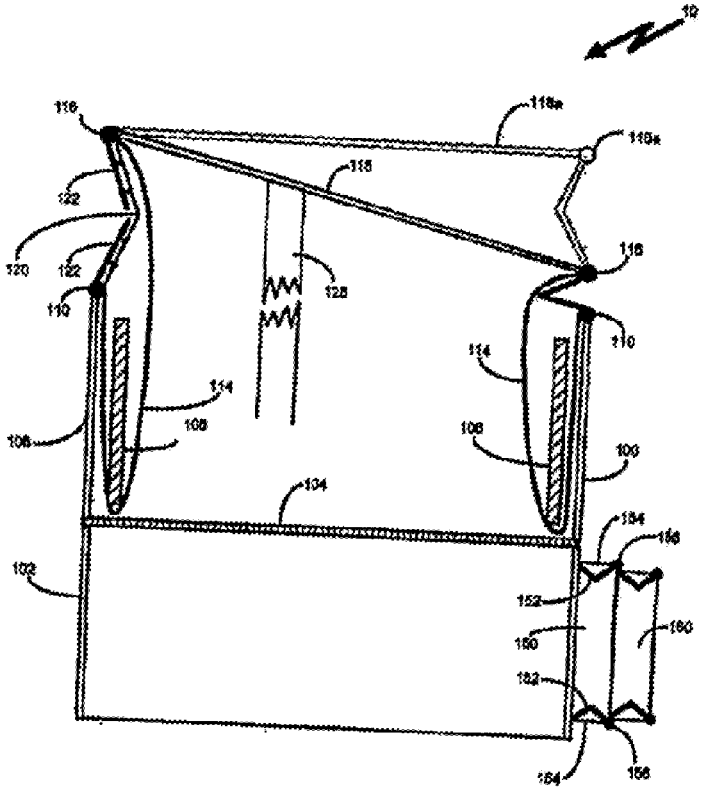

A : FABRIC ANCHOR POINT
B : FABRIC ANCHOR POINT
C : ELASTIC ATTACHMENT
D : ELASTIC ANCHOR POINT TO CONTAINER 12
400
402
402
A
B
C
D
1
404

A : FABRIC ANCHOR POINT
B : FABRIC ANCHOR POINT
D : ELASTIC ANCHOR POINT
• No point "c" required
400
402
A
B
D
10
404

A : FABRIC ANCHOR POINT
B : FABRIC ANCHOR POINT
D : ELASTIC ANCHOR POINT
• No point "c" required
402
A
B
D
10
14
404

SINGLE EXPANSION APPLICATION

DOUBLE EXPANSION APPLICATION

MULTIPLE EXPANSION APPLICATION

UNEVEN EXPANSION OF A SINGLE PANEL

MULTIPLE EXPANSIONS OF THE SAME SIDE